US009421784B2

(12) United States Patent
Kumagai et al.

(10) Patent No.: US 9,421,784 B2
(45) Date of Patent: Aug. 23, 2016

(54) LIQUID EJECTING APPARATUS

(71) Applicant: Seiko Epson Corporation, Tokyo (JP)

(72) Inventors: Toshio Kumagai, Shiojiri (JP); Kaoru Koike, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/686,499

(22) Filed: Apr. 14, 2015

(65) Prior Publication Data

US 2015/0217575 A1 Aug. 6, 2015

Related U.S. Application Data

(62) Division of application No. 12/862,238, filed on Aug. 24, 2010, now abandoned.

(30) Foreign Application Priority Data

Aug. 31, 2009 (JP) ..... 2009-200904

(51) Int. Cl.

| | |
|---|---|
| ***B41J 2/165*** | (2006.01) |
| ***B41J 2/175*** | (2006.01) |
| ***B41J 2/125*** | (2006.01) |

(52) U.S. Cl.

CPC ..... *B41J 2/17566* (2013.01); *B41J 2/125* (2013.01); *B41J 2/16526* (2013.01); *B41J 2/175* (2013.01); *B41J 2/17509* (2013.01); *B41J 2/17596* (2013.01)

(58) Field of Classification Search

None

See application file for complete search history.

(56) References Cited

U.S. PATENT DOCUMENTS

| | | | | |
|---|---|---|---|---|
| 7,360,882 | B2 | 4/2008 | Ikeda et al. | |
| 2002/0113852 | A1 | 8/2002 | Kimura et al. | |
| 2003/0202059 | A1 | 10/2003 | Kimura et al. | |
| 2003/0210309 | A1 | 11/2003 | Kimura et al. | |
| 2006/0132554 | A1 | 6/2006 | Ota et al. | |
| 2008/0158321 | A1 * | 7/2008 | Nitta | B41J 2/175 347/89 |
| 2008/0273064 | A1 | 11/2008 | Ota et al. | |
| 2009/0085994 | A1 * | 4/2009 | Takata | B41J 2/175 347/94 |

FOREIGN PATENT DOCUMENTS

| | | | |
|---|---|---|---|
| JP | 06-336020 | A | 12/1994 |
| JP | 11-342634 | A | 12/1999 |
| JP | 2002-307708 | A | 10/2002 |
| JP | 2003-127417 | A | 5/2003 |
| JP | 20050053047 | A | 3/2005 |
| JP | 2006-326855 | A | 12/2006 |

* cited by examiner

*Primary Examiner* — Alejandro Valencia

(57) ABSTRACT

A liquid ejecting apparatus includes a first passage through which liquid flows from a tank to liquid ejecting heads; and a second passage through which liquid flows from the heads to the tank. The first passage includes a third passage connecting to the tank, a fourth passage branching from the third passage at a first position to allow the third passage to communicate with a first head, and a fifth passage branching from the third passage at a second position to allow the third passage to communicate with a second head. The lengths, cross-sectional areas, and resistances of various passages are set relative to others.

4 Claims, 10 Drawing Sheets

LIQUID EJECTING APPARATUS

CROSS-REFERENCE TO RELATED APPLICATIONS

This application is a divisional of, and claims priority under 35 U.S.C. §120 on, U.S. application Ser. No. 12/862,238, filed Aug. 24, 2010, which claims priority under 35 U.S.C. §119 on Japanese Patent Application No. 2009-200904, filed Aug. 31, 2009. The content of each application identified above is incorporated by reference herein in its entirety.

BACKGROUND

1. Field of Invention

The present invention relates to a liquid ejecting apparatus including liquid ejecting heads ejecting a liquid such as ink.

2. Description of Related Art

In the past, as this kind of liquid ejecting apparatus, an ink jet printer (hereinafter, simply referred to as a "printer") disclosed in JP-A-11-342634 was suggested. The printer disclosed in JP-A-11-342634 includes a plurality of head units (printing heads) as liquid ejecting heads ejecting ink as a liquid to a target such as a print sheet and also includes an ink tank and a sub-tank storing the ink to supply the head units. A purge operation of removing bubbles or solid matter in the ink from the head unit is performed by pressurizing the ink tank by the driving of an air pump, supplying the ink from the ink tank to each head unit via a circulation forward passage of the ink, and storing some of the ink, which is not discharged by each head unit, in the sub-tank via a circulation backward passage. After the purge operation, the ink temporarily stored in the sub-tank is returned to the ink tank and is reused.

SUMMARY OF INVENTION

An advantage of some aspects of the invention is that it provides an improved liquid ejecting apparatus with passages described below.

According to an aspect of the invention, there is provided a liquid ejecting apparatus that includes liquid ejecting heads ejecting a liquid. The liquid ejecting apparatus includes a tank that stores the liquid; a first passage through which the liquid flows from the tank to the liquid ejecting heads; and a second passage through which the liquid flows from the liquid ejecting heads to the tank. The first and second passages define a path along which the liquid flows between the tank and the liquid ejecting heads. The liquid ejecting heads includes a first head and a second head. The first passage includes a third passage connecting to the tank, a fourth passage branching from the third passage at a first position to allow the third passage to communicate with the first head via the fourth passage, and a fifth passage branching from the third passage at a second position to allow the third passage to communicate with the second head via the fifth passage. A passage length from the tank to the first position is shorter than a passage length from the tank to the second position. The fourth passage and the fifth passage are of the same length and cross-sectional area. A cross-sectional area of the third passage is larger than a cross-sectional area of the fourth passage. A passage resistance from the tank to the first position and a passage resistance from the tank to the second position are substantially the same. A passage resistance of the fourth passage is much larger than a passage resistance from the tank to the first position.

According to the aspect of the invention, a difference in the flow rate of the liquid supplied during a liquid ejecting operation between the liquid ejecting heads can be kept small. Moreover, a difference in the pressure of the liquid between the liquid ejecting heads can be kept small.

According to the aspect of the invention, an advantage can be obtained in that the difference in the pressure of the liquid between the liquid ejecting heads can be kept small, while the difference in the flow rate of the liquid supplied during a liquid ejecting operation between the liquid ejecting heads can be kept small.

The liquid ejecting apparatus according to the above aspect of the invention may further include a heating unit heating the liquid to supply heated liquid to the liquid ejecting heads. A flow rate of the liquid supplied to the first head via the fourth passage is set to be greater than a maximum flow rate of the liquid ejected by the first head.

According to the aspect of the invention, the liquid can be prevented from flowing backward due to an insufficient supply of liquid. Therefore, it is possible to prevent the temperature of the liquid in the liquid ejecting head from becoming unstable as a result of the cooled liquid flowing backward into the liquid ejecting head again. As a consequence, since the temperature of the liquid in each liquid ejecting head is kept at a necessary heating temperature, a stable ejection performance can be ensured for each liquid ejecting head.

The liquid ejecting apparatus according to the above aspect of the invention may further include a depressurizing unit depressurizing the tank. The depressurizing unit may depressurize the tank during an ejection operation of the first head.

According to the aspect of the invention, stable ejection performance can be ensured, while preventing excessive ejection of the liquid from the first head or the leakage of the liquid.

In the liquid ejecting apparatus according to the above aspect of the invention, the depressurizing unit may be controlled so that a pressure of the tank becomes a depressurization value corresponding to a flow rate of the liquid circulated in the sixth passage.

According to the aspect of the invention, since the pressure of the tank is controlled to the reduced pressure value in accordance with the flow rate of the liquid circulated in the sixth passage by the depressurizing unit, the liquid pressure of the liquid ejecting head can be maintained at a stable value.

BRIEF DESCRIPTION OF THE DRAWINGS

The invention will be described with reference to the accompanying drawings, wherein like numbers reference like elements.

DESCRIPTION OF THE PREFERRED EMBODIMENTS

Hereinafter, an embodiment of the invention will be described with reference to FIGS. 1 to 11.

Figure 1:
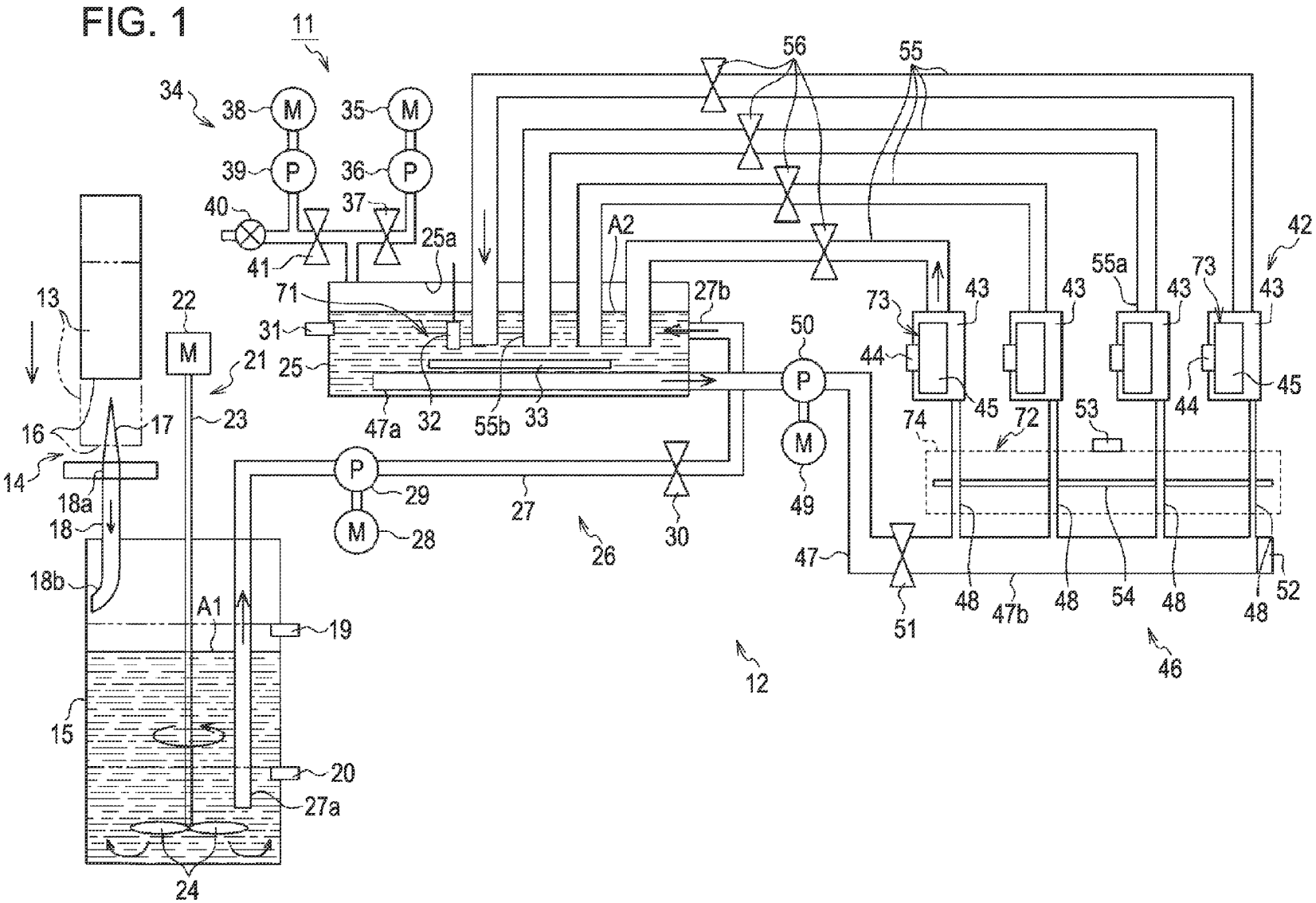
FIG. 1 is a schematic view illustrating a printer according to an embodiment.

As shown in FIG. 1, an ink jet printer (hereinafter, abbreviated to a "printer 11"), which is an example of a liquid ejecting liquid, includes a printing section 12 that performs printing on a target (a film or the like) (not shown) with UV (ultraviolet) ink (ultraviolet curing ink), which is an example of a liquid. The printer 11 according to this embodiment is provided with a radiation unit (not shown) radiating ultraviolet rays to the target subjected to the printing by the printing section 12 and curing the UV ink landed to the target. The UV ink contains a pigment component having low dispersion stability and has a property in which the pigment component readily settles down.

The printing section 12 includes a holder unit 14 mounted with an ink cartridge 13 storing the UV ink and a main tank 15 having a substantially cylindrical shape with a bottom portion and disposed below the holder 14 in the direction of gravity. In the holder unit 14, a hollow ink supply needle 17 detached from and mounted on a extraction unit 16 of the ink cartridge 13 is mounted at the mount position indicated by a two-dot chain line in FIG. 1. A first ink supply pipe 18 having an upstream end 18*a* communicating with the inside of the ink supply needle 17 is connected to the holder unit 14, and a downstream end 18*b* of the first ink supply pipe 18 is disposed in the main tank 15. The main tank 15 is configured so that the allowable storage amount of UV ink is sufficiently larger than that of the UV ink stored in the ink cartridge 13. On the side wall of the main tank 15, a plurality (in this embodiment, two liquid level sensors) of main-side liquid level sensors 19 and 20 are disposed to detect the liquid level of the UV ink remaining in the main tank 15 on the basis of the location of the liquid level A1 of the UV ink. The main-side liquid level sensors 19 and 20 are disposed at different positions in the direction of gravity.

In the printer 12, a churning device 21 is disposed to churn the UV ink stored in the main tank 15. The churning device 21 includes a churning motor 22 supplying a driving source, a shaft member 23 rotated by the driving of the churning motor 22, and a plurality of blade members 24 disposed in the front end (the lower end in FIG. 1) of the shaft member 23.

The printing section 12 includes a sub-tank 25, for which the allowable storage amount of UV ink is smaller than that of the main tank 15, a first liquid supply unit 26 which supplies the UV ink from the main tank 15 to the sub-tank 25. The first liquid supply unit 26 includes: a second ink supply pipe 27 having an upstream end 27*a* disposed inside the main tank 15 and a downstream end 27*b* connected to the sub-tank 25; and first pump 29 sucking the UV ink stored in the main tank 15 by the driving of a first driving motor 28 and discharging the UV ink to the sub-tank 25. A first on-off valve (for example, an electromagnetic valve) 30 operated to permit or regulate flow of the UV ink between the tanks 15 and 25 is disposed in the second ink supply pipe 27 on the side closer to the sub-tank 25 than the first pump 29.

The sub-tank 25 includes a tank main body forming a bottom cylinder and a cover covering the opening of the tank main body. On the side wall of the sub-tank 25, a sub-tank liquid level sensor 31 is disposed to detect the remaining amount of UV ink temporarily stored in the sub-tank 25. An ON signal is output from the sub-tank liquid level sensor 31, when a liquid level A2 of the UV ink in the sub-tank 25 is located at the same position as or higher than the position at which the sub-tank liquid level sensor 31 is installed. In the sub-tank 25, a first temperature sensor 32 is installed to detect the temperature of the UV ink stored in the sub-tank 25 and a sub-tank heater 33 is disposed to heat the UV ink. A pressure adjusting device 34 increasing or decreasing the pressure of the sub-tank 25 is connected to the sub-tank 25.

The pressure adjusting device 34 includes: a second pump 36 which is driven to pressure-feed the gas in the sub-tank 25 by a second driving motor 35 so as to pressurize the inside of the sub-tank 25; and a second on-off valve (for example, an electromagnetic valve) 37 which is opened when the second pump 36 is driven and which is closed when the second pump 36 is not driven. The pressure adjusting device 34 further includes: a third pump 39 which is driven to discharge the gas from the sub-tank 25 by a third driving motor 38 so as to depressurize the inside of the sub-tank 25; and a pressure opening plate 40 which is opened to the air until the pressure is increased to the pressure set in the sub-tank 25. Moreover, the pressure adjusting device 34 includes a third on-off valve (for example, an electromagnetic valve) 41 which is opened when at least one of the third pump 39 and the pressure opening plate 40 is driven and which is closed when none of the third pump 39 and the pressure opening plate 40 are driven.

An ink ejecting unit 42 ejecting the UV ink toward the target is disposed in the printing section 12. The ink ejecting unit 42 includes a plurality (in this embodiment, four printing heads) of printing heads 43 (a liquid ejecting head (liquid ejecting unit)). Each of the printing heads 43 appropriately ejects the UV ink supplied to the inside of the printing head 43 from nozzles. Each of the printing heads 43 includes a second temperature sensor 44 detecting the temperature of the UV ink supplied to the inside of the printing head 43 and a head heater 45 keeping the temperature of the UV ink therein.

The UV ink stored in the sub-tank 25 is supplied to each printing head 43 via a second liquid supply unit 46. The second liquid supply unit 46 includes a third ink supply pipe 47 (supply passage) having an upstream end 47*a* disposed in the vicinity of the bottom portion of the sub-tank 25. The third ink supply pipe 47 includes: one common pipe 47*b* on the upstream side; and a plurality (in this embodiment, four connection pipes) of connection pipes 48 (connection passages) branching in parallel from the common pipe 47*b* and disposed on the downstream side so as to be connected to the printing heads 43 respectively and to correspond to the printing heads 43 individually. In the third ink supply pipe 47, a fourth pump 50 is disposed to suck the UV ink from the sub-tank 25 and send the UV ink to the printing heads 43 by the driving of a fourth driving motor 49. A fourth on-off valve (for example, an electromagnetic valve) 51 operated to allow and regulate flow of the UV ink from the sub-tank 25 to the printing heads 43 and a damper 52 attenuating pulsation of the UV ink supplied through the fourth pump 50 are disposed in the third ink supply pipe 47 closer to the printing heads 43 than the fourth pump 50. As the first to fourth pumps, a reciprocating pump such as a diaphragm pump, a tube pump, a piston pump, or a plunger pump may be used, or a rotary pump such as a gear pump, a vane pump, or a screw pump may be used.

Each connection pipe 48 is designed to have a passage cross-section area S2 smaller than a passage cross-section area S1 of the common pipe 47*b*. The UV ink flowing inside each connection pipe 48 is heated by a supply passage heater 54 controlled on the basis of a signal detected by a third temperature sensor 53.

A plurality (in this embodiment, four ink circulation pipes) of ink circulation pipes 55 corresponding to the printing heads 43 individually are disposed between the printing heads 43 and the sub-tank 25. Each of the upstream ends 55*a* of the ink circulation pipes 55 is connected to each of the printing heads 43. Each of downstream ends 55*b* of the ink circulation pipes 55 is disposed inside the sub-tank 25. The ink circulation pipes 55 have a passage cross-section area S3 smaller than the passage cross-section area S1 of the common pipe 47*b* and larger than the passage cross-section area S2 of the connection pipe 48 (where S1>S3>S2). A fifth on-off valve (for example, an electromagnetic valve) 56 operated to allow or regulate the flow of the UV ink from each printing head 43 to the sub-tank 25 is disposed in each ink circulation pipe 55.

The printing section 12 includes a transport unit (not shown) transporting the target. The printing is performed on the target by ejecting the UV ink by the printing heads 43 to the target transported by the transport unit. The transport unit includes a known transport mechanism such as a roller type transport mechanism, a belt type transport mechanism, or a rotation drum type transport mechanism and a transport motor 57 (see FIG. 2). The transport unit transports the target, when the transport mechanism is driven by the transport motor 57 (see FIG. 2).

The printer 11 having the above-described configuration is operated as follows. That is, the ink cartridge 13 is disposed at a standby position at which the ink supply needle 17 is not inserted into the extraction unit 16. When the liquid level A1 of the UV ink in the main tank 15 is lowered and the ON state of the first main tank liquid level sensor 19 disposed above becomes the OFF state, a detachable motor is driven on the basis of a control instruction from a control device 60, which is described below. Then, a press member as a pressurizing device (not shown) disposed above the holder unit 14 moves the ink cartridge 13 disposed at the standby position downward against the urging force of an urging unit. As a result, the ink cartridge 13 is mounted on the holder unit 14 disposed at the mount position into which the ink supply needle 17 is inserted. The UV ink stored in the ink cartridge 13 is taken out to the main tank 15 via the ink supply needle 17 and the first ink supply pipe 18. At this time, in the main tank 15, the UV ink is churned by the churning device 21 for a predetermined time.

The control device 60 of the printer 11 measures an amount of ink consumed by the printing heads 43. Therefore, when it is determined on the basis of the measurement result that a predetermined amount of UV ink in the sub-tank 25 is consumed from the state of the liquid level A2 where the sub-tank liquid level sensor 31 is turned on, the first pump 29 is driven to supply the UV ink from the main tank 15 to the sub-tank 25. When the liquid level A2 of the UV ink in the sub-tank 25 is raised and the OFF state of the sub-tank liquid level sensor 31 becomes the ON state, the control device 60 stops driving the first pump 29 and stops supplying the UV ink from the main tank 15 to the sub-tank 25.

By driving the fourth pump 50 while depressurizing the sub-tank 25 by the pressure adjusting device 34 upon the printing, the UV ink is supplied from the sub-tank 25 to the printing heads 43 via the third ink supply pipe 47, the UV ink flows from the printing heads 43 to the ink circulation pipes 55, and then the UV ink flows back to the sub-tank 25. The ink is supplied to the printing heads 43 by circulating the ink through the third ink supply pipe 47 and the ink circulation pipes 55 between the sub-tank 25 and the printing heads 43. The ink stored in the sub-tank 25 is gradually decreased by the amount of ink consumed by ejecting the ink from the nozzles of the printing heads 43.

In the printer 11, temperature control is executed in such a manner that the UV ink in the sub-tank 25 and the third ink supply pipe 47 is heated by the sub-tank heater 33 and the supply passage heater 54, respectively and the temperature of the UV ink supplied in the heated state is kept in the printing heads 43 by the head heaters 45. In the printer 11, a first cleaning operation is performed to remove the bubbles of the ink in the printing heads 43. Moreover, a second cleaning operation is performed to prevent and solve the clogging of the nozzle of the printing heads 43.

The printing section 12 is configured to eject the UV ink of plural colors to the target. The printing section 12 includes the holder unit 14, the tanks 15 and 25, and printing units including ink ejecting units 42 for respective colors. In this embodiment, however, only a printing unit for a mono-color (for example, white) will be described. The description of the printing units for other colors is omitted for easy understanding of the specification. In the following description, the UV ink is also just referred to as the ink.

Figure 2:
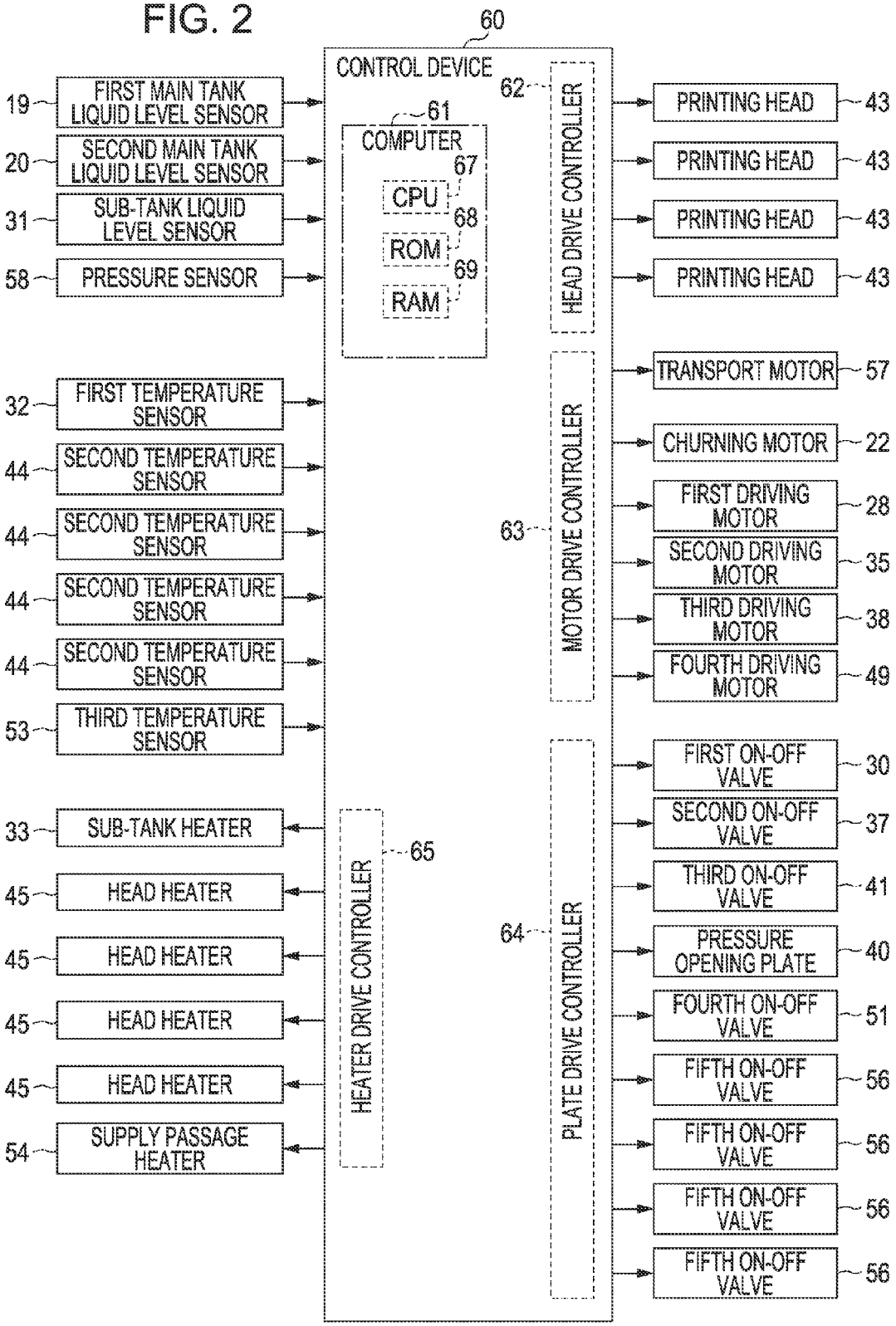
FIG. 2 is a block diagram illustrating the electric configuration of the printer.

Next, the electric configuration of the printing section 12 according to this embodiment will be described with reference to FIG. 2. As shown in FIG. 2, the printer 11 includes the control device 60 controlling an ink supply system and a printing system as a whole. In an input/output interface of the control device 60, the first main tank liquid level sensor 19, the second main tank liquid level sensor 20, the sub-tank liquid level sensor 31, and a pressure sensor 58 detecting pneumatic pressure of the sub-tank 25 are electrically connected as sensors of the ink supply system. In the input/output interface of the control device 60, the first temperature sensor 32, the four second temperature sensors 44, and the third temperature sensor 53 are electrically connected as heating control sensors.

In the input/output interface of the control device 60, the four printing heads 43 and the transport motor 57 are electrically connected as control targets of the printing system. In the input/output interface of the control device 60, the first driving motor 28, the second driving motor 35, third driving motor 38, and the fourth driving motor 49 for driving the pumps; the first on-off valve 30, the fourth on-off valve 51, and the four fifth on-off valves 56 for opening and closing the passage; and the second on-off valve 37, the third on-off valve 41, and the pressure opening plate 40 forming the pressure adjusting device 34 are electrically connected as control targets of the ink supply system.

In the input/output interface of the control device 60, the sub-tank heater 33 for heating the ink, the supply passage heater 54 for heating the ink, and the four head heaters 45 for keeping the temperature of the ink are electrically connected.

The control device 60 further includes a computer 61 (microcomputer) executing a variety of control on the basis of the detection results input from the sensors 19, 20, 31, 32, 44, 53, and 58, a head drive controller 62 controlling the driving of the printing heads 43, a motor drive controller 63 controlling the driving of the motors 57, 22, 28, 35, 38, and 57, a plate drive controller 64 controlling the on-off valves 30, 37, 41, 51, and 56 and the pressure opening plate 40, and a heater drive controller 65 controlling the heating of the heaters 33, 45, and 54.

The control device 60 controls a print operation, a transport operation, a pump operation, a plate drive operation, a heating operation, and the like, when the computer 61 gives control detail (instruction value) instruction to the drive controllers 62 to 65. Here, the computer 61 includes a CPU 67, a ROM 68, and a RAM 69. The ROM 68 stores program data used for the CPU 67 to perform a variety of control and various data including setting values used to perform the variety of control. The RAM 69 temporarily stores the calculation results and the like of the CPU 67. Some areas of the RAM 69 are used as a buffer developing print data input from a host apparatus (not shown), for example. The drive controllers 62 to 65 are structured by ASIC (Application Specific Integrated Circuit) and various drive circuits, and the like. A plurality of the CPUs 67 may be installed to control a printing system (transport system and ejection system), the ink supply system, and a heating system, individually.

For example, the computer 61 performs duty control to control the amount of ink ejected from the nozzles of the printing head 43 by instructing a duty value D corresponding to the amount of ink ejected by the head drive controller 62. At this time, the duty value D instructed by the computer 61 is varied in the range from 0% to 100%. The amount of ink ejected (which is equal to the amount of ink ejected per one ejection) is increased nearly in proportion to an increase in the duty value (%). When ink droplets are ejected from all of the nozzles in each ejection period by instructing the duty value of 100% (FULL duty) to all of the printing heads 43, the amount of ink (ink ejection rate Qh) ejected from the nozzles of the printing heads 43 per unit time becomes the maximum.

In the printer 11 according to this embodiment, the first cleaning operation is performed to remove the bubbles in the ink of the printing heads 43 using the ink circulation flow and the second cleaning operation (nozzle cleaning operation) is performed to prevent and solve the clogging of the nozzles by forcibly discharging the ink from the nozzles 84 (see FIG. 8) of the printing heads 43.

For example, when the same ink (for example, the same color ink) of the ink cartridge 13 is consumed and thus the ink cartridge 13 is replaced, bubbles in ink may be mixed therein via the ink supply needle 17 upon mounting the ink cartridge 13 on the holder unit 14. Alternatively, when the ink cartridge 13 is replaced by a new ink cartridge of another ink (for example, different color ink), all of the ink in the tanks and the passages is replaced with the different color ink, and an initial filling operation is performed to fill the passages with the different color ink. Alternatively, a gas may penetrate in portions, in which the resin tube is used in the ink supply pipes 18, 27, and 47 and the ink circulation pipes 55, and the air dissolved in the ink of the passages may become the bubbles when the printer 11 is not used for a long time. When the ink cartridge is replaced, the initial filling is performed, or the printer is not used for a long time, bubbles may gather at the corners of an area on the upstream side of a filter 83 (see FIG. 8) in the printing head 43 or bubbles are captured in the filter 83. For this reason, the first cleaning operation is performed mainly to remove the bubbles in the ink of the printing head 43 as a whole using the ink circulation flow. That is, the computer 61 shown in FIG. 2 performs the first cleaning operation, when measurement time T of an internal timer measuring elapsed time from the detection time of replacement of the ink cartridge, the detection time of the initial filling, or the end time of the previous second cleaning operation reaches first cleaning time T1.

The second cleaning operation is performed to prevent and solve the clogging of the nozzles of the printing head 43, when a cleaning instruction is received by the operation of a user or the cleaning operation is scheduled to be performed. That is, the computer 61 shown in FIG. 2 performs the second cleaning operation, when the cleaning instruction is received by the operation of a user or the measurement time T of the internal timer measuring the elapsed time from the end time of the previous second cleaning operation reaches the second cleaning time T2.

The second cleaning operation is performed by driving the second pump 36 (pressurizing pump) and pressurizing an air chamber 25*a* in the sub-tank 25 to pressurize the ink of the sub-tank 25, supplying the ink in the pressurized state from the sub-tank 25 to the printing heads 43 via the ink circulation pipes 55, and forcibly discharging the ink from the nozzles of the printing heads 43. Therefore, the second cleaning operation is performed in two steps: a step (pressurizing step) of closing the passages of the ink circulation pipes 55 and accumulating the ink pressure on the upstream side including the sub-tank 25; and a step (a valve opening step) of opening the passages of the ink circulation pipes 55 at a time at which the ink pressure is accumulated up to a target value and flowing the ink to the downstream side at once to forcibly discharge the ink from the nozzles 84.

That is, in the pressure accumulation step of the second cleaning operation, the second pump 36 (pressurizing pump) is driven to pressurize the ink of the sub-tank 25 in the state where the on-off valves 30, 41, 51, and 56 are closed and the on-off valve 37 is opened and the driving of the pumps 29, 39, and 50 is also stopped.

In this embodiment, there is used a selection cleaning operation of selecting M (where $1 \leq M < N$) printing heads 43 to be subjected to the second cleaning operation among all (N) of the printing heads 43 and cleaning only the selected M printing heads 43. In the printer 11, a nozzle inspection device (not shown) capable of inspecting the clogging of the nozzles is installed in each printing head 43. Only the printing heads 43 determined as requiring cleaning on the basis of the inspection result of the nozzle inspection device become cleaning targets.

For example, the strengths of the plural-phase steps are prepared in the second cleaning operation. When the second cleaning operation is repeatedly instructed by the operation of a user, a strong cleaning operation is selected due to an increase in the number of operations and a strong cleaning operation is selected on the basis of a long elapsed time from the time at which the previous cleaning operation is performed. In the pressure accumulation step, the control device 60 starting the driving of the second pump 36 determines that the pressure accumulation step ends, when the pressure sensor 58 detects the pressure (pneumatic pressure) of the air chamber 25*a* and the pressure reaches a target pressure corresponding to the selected cleaning strength. After the pressure accumulation step ends, the second cleaning operation is performed only on the M printing heads 43 by opening only the on-off valves 56 of the ink circulation pipes 55 connected to the M printing heads 43 determined as requiring cleaning on the basis of the detection results of the nozzles among the N on-off valves 56.

In this embodiment, the passage resistances of the third ink supply pipe 47 and the ink circulation pipes 55 are set as follows. That is, a passage resistance R ($\cong$R2>R1) of the third ink supply pipe 47 (supply passage) and a passage resistance R3 of the ink circulation pipes 55 are set to satisfy a relation of R<R3. Therefore, the amounts of ink supplied to the printing heads 43 can be made equal to each other. Moreover, the ink pressures of the printing heads 43 can be kept low, while a difference between the ink pressures of the printing heads 43 is kept small. As a consequence, the ink from the nozzles of each printing head 43 can be prevented from leaking during the printing. Moreover, an appropriate amount of ink droplets can also be ejected since the ink pressure in each printing head 43 falls within an allowable range.

A passage resistance R1 of the common pipe 47*b* of the third ink supply pipe 47, a passage resistance R2 of the connection pipe 48, and the passage resistance R3 of the ink circulation pipe 55 are set to satisfy a relation of R1<R3<R2. Therefore, the amounts of ink supplied to the printing heads 43 can be made equal to each other. Moreover, the ink pressures of the printing heads 43 can be kept low, while the difference between the ink pressures of the printing heads 43 is kept small.

Here, among the passage resistances R1, R2, and R3, the passage resistance R1 of the common pipe 47*b* is set to be the smallest and the passage resistance R2 of the connection pipe 48 is set to be largest. Then, the ink pressures can be made nearly equal to each other in the entrances of the connection pipes 48 on the common pipe 47*b*. By setting the passage resistance R2 of each connection pipe 48 to be very large, the amounts of ink supplied to the printing heads 43 can be made nearly equal to each other. The ink pressure has a tendency to be increased in the printing head 43, as the passage resistance R3 of the ink circulation pipe 55 is large. However, since the passage resistance R3 of the ink circulation pipe 55 is set to be small, the ink pressure of the printing head 43 can be kept low. At this time, since ink supply rates Qin to the printing heads 43 are nearly equal to each other and ink ejection rates Qh from the printing heads 43 are different from each other, ink circulation rates Qout (=Qin−Qh) become different from each other between the printing heads 43. However, since the passage resistance R3 of the ink circulation pipes 55 is set to be small, a pressure loss P3loss (=Qout·R3) of the ink circulation pipe 55, which is calculated by a product of the ink circulation rate Qout and the passage resistance R3, has a small value. Therefore, since the pressure losses P3loss of the printing heads 43 are considered to be nearly equal to each other, the ink pressures of the printing heads 43 can be made nearly equal to each other between the printing heads 43.

The reason for allowing the passage resistance R1 of the common pipe 47*b* and the passage resistance R3 of the ink circulation pipe 55 to satisfy the relation of R1<R3 is that the passage resistance R3 of the ink circulation pipe 55 is made as small as possible. Above all, at least upon the printing, the ink circulation rate Qout is smaller than the ink supply rate Qin since the ink is ejected by the printing heads 43. Therefore, the diameter of the ink circulation pipe 55 is designed to be small by the amount of ink ejected by the printing heads 43, and thus the ink circulation pipes 55 are designed to be miniaturized. Moreover, it is necessary to allow the variation in the ink pressure of the printing head 43 within ±50 Pa. Therefore, the passage resistance R3 of the ink circulation pipe 55 is determined so that the variation in the ink pressure of the printing head 43 falls within ±50 Pa in a range of the variation in the ink circulation rate Qout between the maximum printing time and non-printing time.

Since it is necessary to allow the variation in the ink pressure in a given printing mode to fall within ±50 Pa, the passage resistance R2 of the connection pipe 48 is set to be five or more times the passage resistance R3 of the ink circulation pipe 55 (where R2≥5·R3). Therefore, even when the printing is performed in the given printing mode, the variation in the ink pressure of the printing head 43 falls within ±50 Pa. Accordingly, the amount of ink ejected from the nozzles of the printing head 43 can be stabilized.

Figure 3:
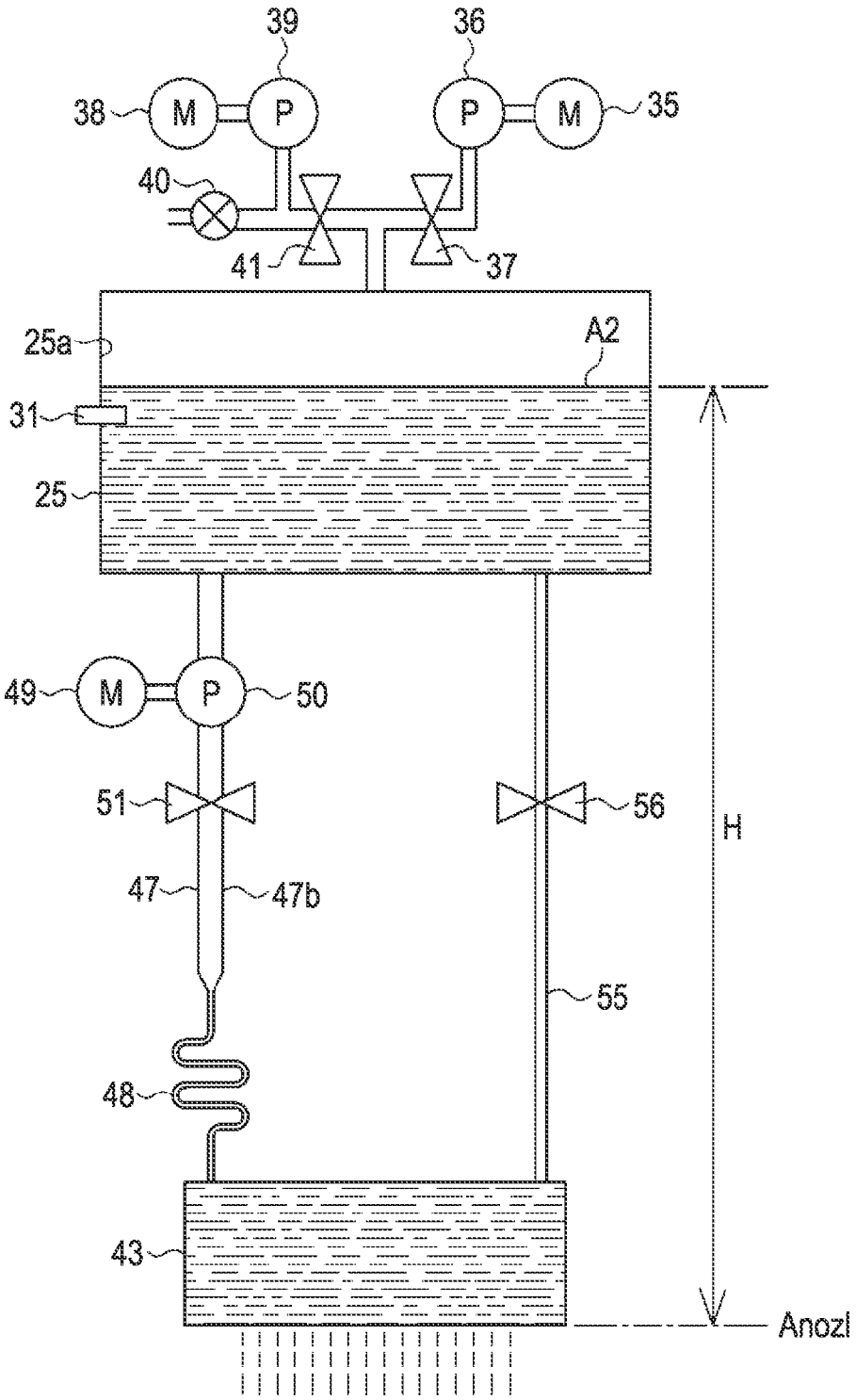
FIG. 3 is a schematic side view illustrating an ink supply system including a sub-tank and printing head.

FIG. 3 is a schematic view illustrating the ink supply system including the sub-tank and the printing head. As shown in FIG. 3, the sub-tank 25 is disposed above the printing head 43 in the direction of gravity. In this embodiment, the printing head 43 has no pressure adjusting valve. Therefore, the ink pressure of the nozzles 84 of the printing head 43 is adjusted using a liquid head difference H which is a distance between the height of the liquid level A2 in the sub-tank 25 and the surface height Anozl of an ink meniscus in the nozzles of the printing head 43.

Here, the ink pressure of the nozzles 84 of the printing head 43 is influenced not only by the liquid head difference H between the liquid level A2 in the sub-tank 25 and the surface height Anozl of the ink meniscus in the nozzles but also by the passage resistance of the ink flowing in the passages including the third ink supply pipe 47 and the ink circulation pipe 55 and the ink pressure of the sub-tank 25. In this embodiment, therefore, the ink pressure of the ink meniscus in the nozzles 84 of the printing head 43 is adjusted so as to have an appropriate value by controlling the air chamber 25*a* in the sub-tank 25 by the negative pressure to set the pressure of the sub-tank 25 to be negative by the pressure adjusting device 34.

In the printing head 43, the pressure chamber (not shown) communicating with the nozzle 84 (see FIG. 8) is provided in each nozzle. Therefore, when a pressure generating element disposed in each nozzle on the opposite side of the nozzle in the pressure chamber is driven, the pressure chamber is expanded and contracted. The ink sucked to the pressure chamber upon expanding the pressure chamber is ejected from the nozzle 84 upon contracting the pressure chamber. At this time, the surface height Anozl of the ink meniscus in the nozzle 84 is determined depending on the ink pressure (that is, the ink pressure in the range of the nozzles) of the pressure chamber. In order to keep the ink ejection performance stable, the surface height Anozl of the ink meniscus has to be maintained at an appropriate position in the nozzle 84. For example, when the surface of the ink meniscus in the nozzle 84 is located inside the nozzle due to the fact that the ink pressure of the pressure chamber is too low, the amount of ink ejected may be insufficient or ejection mistakes may easily occur. Alternatively, when the surface of the ink meniscus in the nozzle protrudes in a circular-surface form from the nozzle opening due to the fact that the ink pressure of the pressure chamber is too high, the amount of ink ejected is excessive or leakage of ink from the nozzle may occur. In this embodiment, therefore, ink supply control is performed so that the ink pressure of the ink meniscus is kept at an appropriate value.

Hereinafter, the ink supply control will be described with reference to FIG. 3. Here, the liquid head difference H (liquid surface height difference) between the surface height Anozl of the ink meniscus in the nozzle and the passage resistance R1 of the common pipe 47*b*, the passage resistance R2 of the connection pipe 48, the passage resistance R3 of the ink circulation pipe 55, and the liquid level A2 of the ink in the sub-tank 25 is set to a negative pressure value Pdec (depressurization value) of the sub-tank 25.

In this example, the amount of ink supplied from the fourth pump 50 (supply pump) is constant at 20 N (cc/minute). Here, P(H) denotes the pressure generated by the liquid head difference H, P1loss denotes a pressure loss caused by the passage resistance R1 of the common pipe 47*b*, P2loss denotes a pressure loss caused by the passage resistance R2 of the connection pipe 48, and P3loss denotes a pressure loss caused by the passage resistance R3 of the ink circulation pipe 55. As for the pressure loss P3loss, the ink circulation rate Qout of the ink circulation pipe 55 varies in accordance with the duty value D and the ink circulation rate Qout can be represented by a function Qout(D) of the duty value D. The pressure loss P3loss can also be represented by a function P3loss(D) (=R1·Qout(D)) of the duty value D.

An ink pressure Ph of the ink meniscus in the nozzle of the printing head 43 can be expressed as Ph=P(H)+Pdec−P1loss−P2loss+P3loss(D). The pressure is expressed as a positive pressure (>0) and a negative pressure (<0) on the assumption that 1 atmosphere pressure is "0". Since Pdec is a negative pressure, a relation of Pdec<0 is satisfied.

In this embodiment, in order to maintain the ink pressure Ph at a target value appropriate for the ink ejection, the third pump 39 (depressurizing pump) and the pressure opening plate 40 are controlled so that the pressure of the air chamber 25*a* becomes a target negative pressure value Pdectrg in response to the pressure loss P3loss(D) (=Qout(D)·R3) varying in accordance with the ink circulation rate Qout(D). The target negative pressure value Pdectrg is expressed as Expression of Pdectrg=Po·Ph(H)−P3loss(D). Here, Po is an integer expressed as Po=Phtrg+P1loss+P2loss on the assumption that the target value of Ph is Phtrg.

The ink ejection rate Qh of the printing head 43 is varied depending on a printing mode, even when the duty value D is the same. Therefore, the printing mode is taken into consideration, when the target negative pressure value Pdectrg is requested. Examples of the printing mode include a high-speed printing mode), where print speed is preferred over a print quality, and a low-speed printing mode (high-quality printing mode, where print quality is preferred over printing speed. In the high-speed printing mode, the ink ejection rate Qh (cc/minute) is larger than that of the low-speed printing mode due to the fact that the printing speed is high, even when the same image is printed. Therefore, each function P3loss (D) is prepared for both the high-speed printing mode and the low-speed printing mode in the ROM 68. In addition, the target negative pressure value Pdectrg is calculated using the above expression to which the function P3loss(D) is applied in accordance with the printing mode read from the ROM 68.

In this embodiment, the computer 61 of the control device 60 calculates the target negative pressure value Pdectrg using the expression of Pdectrg=Po−Ph(H)−P3loss(D) on the basis of the liquid head difference H determined from the printing mode and the liquid surface height Hsub of the liquid level A2 of the ink in the sub-tank 25 and the duty value D for the control of the printing head. Then, the computer 61 controls the third driving motor 38 for the third pump 39 (depressurizing pump) and the pressure opening plate 40 so that a real negative pressure value Pdet detected by the pressure sensor 58 is identical to the target negative pressure value Pdectrg.

On the assumption that h is a distance from the liquid surface height Hsub and the inner bottom surface of the sub-tank 25 to the height (≅the surface height Anozl of the ink meniscus) of the nozzle opening, the liquid head difference H is calculated by the expression of H=Hsub+h. Here, the liquid surface height Hsub is calculated by the expression Hsub=Hsubo+ΔA, using the given liquid surface height Hsubo, obtained when the liquid level is detected by the sub-tank liquid level sensor 31, as a reference and a liquid level variation ΔA of the sub-tank 25 after the detection. The liquid level variation ΔA is calculated by dividing the amount of ink supplemented from the first pump 29 to the sub-tank 25 after the detection of the sub-tank liquid level sensor 31 and the amount of ink varied in the sub-tank 25 obtained by the measurement result of the amount of ink ejected and consumed by the printing head 43 or the calculation result by the cross-section area parallel to the liquid level of the sub-tank 25. Of course, a liquid level sensor detecting the amount of liquid of the sub-tank 25 is provided to calculate the liquid surface height Hsub on the basis of a detection value of the liquid level sensor.

For example, when a print amount is small and the duty value D is relatively small, the ink circulation rate Qout becomes large. When the print amount is large and the duty value D is relatively large, the ink circulation rate Qout becomes small. When the ink circulation rate Qout is large, the pressure loss P3loss determined by the product of the passage resistance R3 and the ink circulation rate Qout is large and an increase in the ink pressure of the ink meniscus is relatively large. For this reason, the target negative pressure value Pdectrg is set to be large on the depressurization side. Alternatively, when the ink circulation rate Qout is small, the pressure loss P3loss determined by the product of the passage resistance R3 and the ink circulation rate Qout is small and an increase in the ink pressure of the ink meniscus is relatively small. For this reason, the target negative pressure value Pdectrg is set to be small on the depressurization side.

Next, a heating system will be described in which the ink is heated during the supply of the ink from the sub-tank 25 disposed in the printer 11 to the printing head 43 and the temperature of the heated ink supplied to the printing head 43 is kept in the printing head 43.

As shown in FIG. 1, the heating system includes a first heating device 71 (first heating unit) preliminarily heating the ink of the sub-tank 25 supplied from the main tank 15 to the sub-tank 25 via the second ink supply pipe 27 so as to have a target temperature and a second heating device 72 (second heating unit) heating the ink, which is supplied to the third ink supply pipe 47 in the state where there is a slight gap in the temperature of the ink heated in the sub-tank 25, at the positions of the connection pipes 48 so as to have the target temperature while eliminating the temperature gap. The heating system further includes temperature keeping devices 73 (third heating unit) installed in each printing head 43 to keep the temperature of the heated ink supplied to each printing head 43 via the third ink supply pipe 47 at the target temperature.

The first heating device 71 includes a sub-tank heater 33 (tank heater) disposed inside the sub-tank 25 and a first temperature sensor 32 detecting the temperature of the ink in the sub-tank 25. The control device 60 performs heating control of the sub-tank heater 33 so that the temperature (the temperature of the ink at the position of the first temperature sensor 32) detected by the first temperature sensor 32 becomes a first target temperature (target value), which is the target temperature of the ink in the sub-tank 25.

The second heating device 72 includes a supply heater 54 heating the heated ink supplied from the sub-tank 25 at the position of the connection pipes 48 of the third ink supply pipe 47, a heat transfer member 74 (heating block) heating the connection pipes 48 by transferring the heat of the supply heater 54, and a third temperature sensor 53 detecting the temperature of the heat transfer member 74. The control device 60 performs heating control of the supply heater 54 so that the temperature (surface temperature of the heat transfer member 74) detected by the third temperature sensor 53 becomes a second target temperature (target value).

The temperature keeping device 73 includes a head heater 45 keeping the temperature of the heated ink of the printing head 43 and a second temperature sensor 44 detecting the temperature of the head heater 45. The control device 60 performs the heating control of the head heater 45 so that the temperature (surface temperature of the head heater 45) detected by the second temperature sensor 44 becomes a third target temperature (target value) to maintain the temperature of the ink of the printing head 43.

Figure 4:
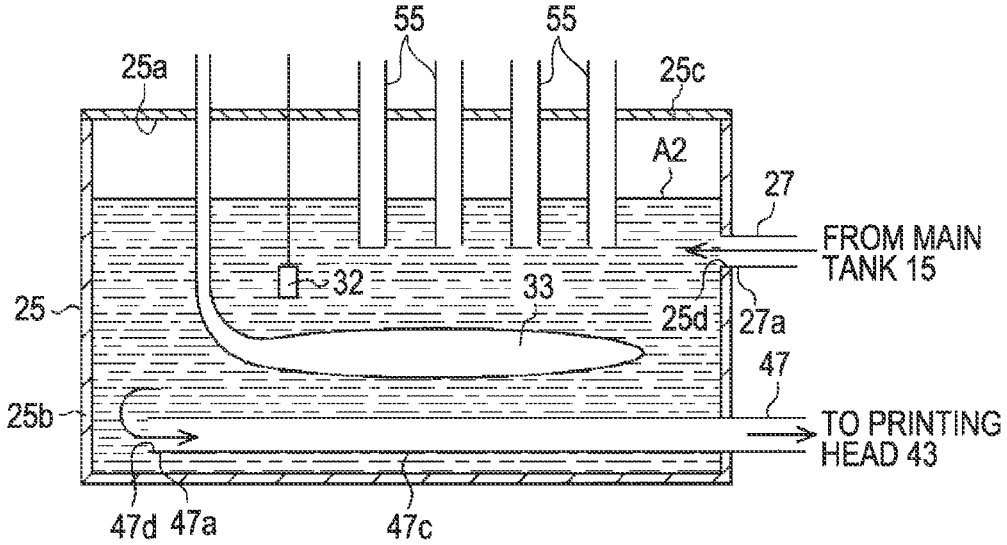
FIG. 4 is a schematic side sectional view illustrating a first heating device.
Figure 5:
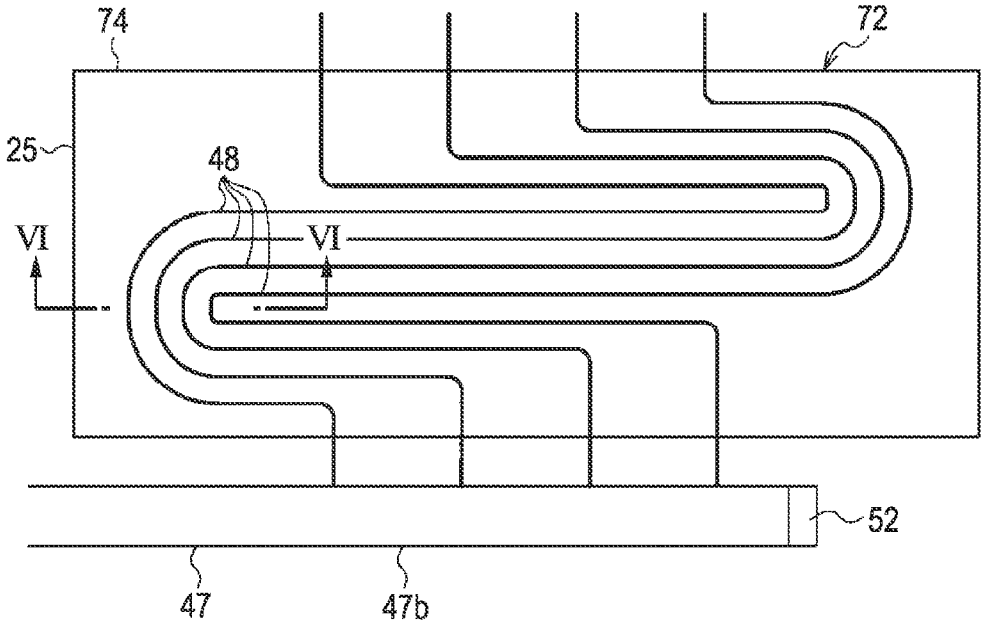
FIG. 5 is a schematic top sectional view illustrating a second heating device of which some constituent elements are removed.
Figure 6:
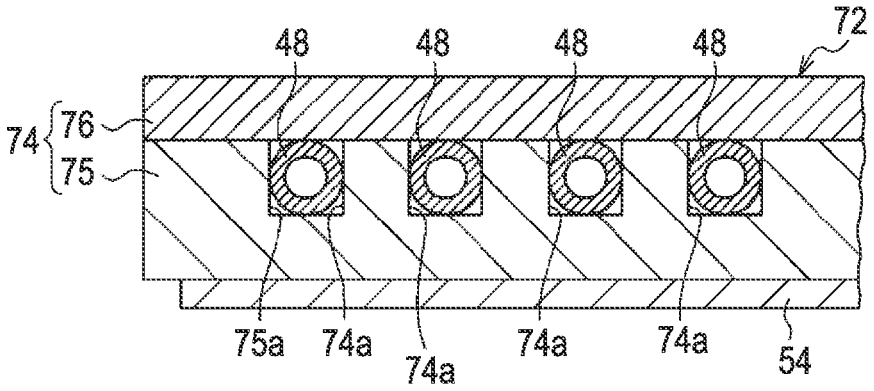
FIG. 6 is a sectional view illustrating the second heating device taken along the line VI-VI of FIG. 5.
Figure 7:
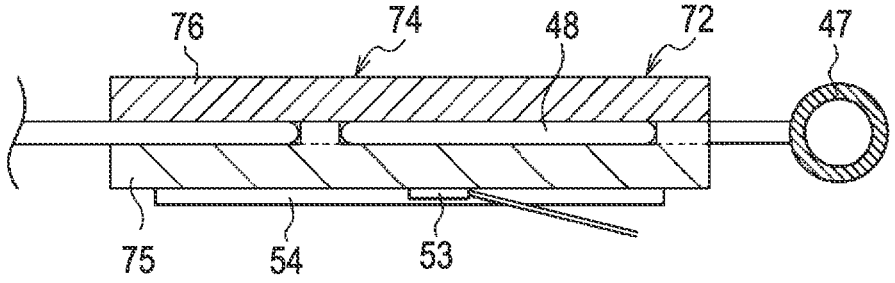
FIG. 7 is schematic sectional view illustrating the second heating device taken along another direction different from that of FIG. 6.
Figure 8:
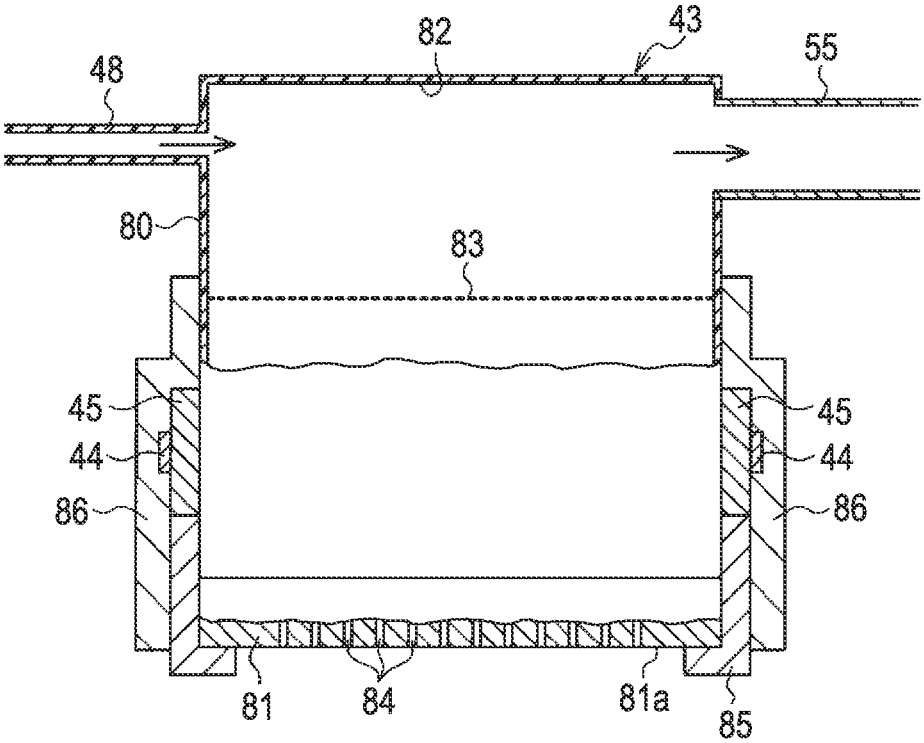
FIG. 8 is a partially exploded sectional view schematically illustrating the printing head in which a temperature keeping device is installed.

Next, the configurations of the first heating device 71, the second heating device 72, and the temperature keeping device 73 will be described in detail. FIG. 4 is a sectional view illustrating the sub-tank 25 including the first heating device 71. FIG. 5 is a schematic sectional view illustrating the second heating device 72. FIG. 6 is a partially sectional view schematically illustrating the second heating device 72 taken along the line VI-VI of FIG. 5. FIG. 7 is a schematic sectional view illustrating the cross-section of the second heating device 72 in a direction perpendicular to FIG. 6. FIG. 8 is a partially exploded sectional view schematically illustrating the printing head 43.

First, the configuration and function of the first heating device 71 will be described. As shown in FIG. 4, the sub-tank 25 includes a cylindrical tank main body 25*b* having a bottom and a cover 25*c* blocking the opening of the tank main body 25*b*. The sub-tank 25 is made of a material with a relatively low heat conductivity, a high heat resistant property, and a corrosion resistant property into which the ink rarely intrudes. An example of the material is glass. For example, when a heater is disposed on the outer wall surface of a metal container made of a stainless steel or the like, the heat is transferred from the inner circumferential surface of the container toward the ink. Therefore, it takes a relatively long time to heat the ink up to the first target temperature (for example, 40° C.). In this embodiment, however, since the sub-tank heater 33 is dipped into the ink in the sub-tank 25, the ink near the sub-tank heater 33 located in a slightly lower portion of the middle is first heated. Therefore, it takes a relatively short time until the average temperature of all of the ink reaches the target temperature. Since the sub-tank 25 is made of an inorganic material (such as glass) of which the heat conductivity is smaller than that of metal, it is difficult for the heat of the heated ink to dissipate from the wall of the sub-tank 25 to the outside. Therefore, the time required to heat the ink to the first target temperature is short.

Here, the ink is intermittently supplied to the sub-tank 25. Of the ink heated to the first target temperature, the ink with the normal temperature flows in. In this embodiment, as shown in FIG. 4, the first temperature sensor 32 is disposed at the position separated by a predetermined distance from an ink inflow port 25*d* (liquid inflow portion) from the main tank 15 in the ink of the sub-tank 25. Here, the first temperature sensor 32 is disposed under the arrangement condition that the first temperature sensor 32 is disposed at the position opposite to the ink inflow port 25*d* relative to an imaginary surface perpendicular to an imaginary line binding the center of the ink inflow port 25*d* and the sub-tank heater 33 and passing through the center of the sub-tank heater 33. When the temperature sensor 32 is located near the ink inflow port 25*d*, the temperature of the ink cooled immediately when the ink starts flowing in is detected by the sub-tank heater 33 and thus the sub-tank heater 33 heats the ink rapidly. At this time, during the flowing of the ink, the flow of the ink has a mixing effect on the ink of the sub-tank 25, whereby the temperature of the ink is increased while the ink is mixed. Therefore, the temperature of the entire ink easily increases. However, since the mixing operation resulting from the flow of the ink disappears after the end of the ink inflow, the temperature of the ink near the ink inflow port locally increases. When the temperature of the ink locally reaches the target heating temperature, the sub-tank heater 33 stops heating the ink at this time in spite of the fact that the temperature of the ink in other positions is low. For this reason, a temperature distribution of the ink of the sub-tank 25 occurs. Moreover, the center of the sub-tank heater 33 upon determining the arrangement condition of the first temperature sensor 32 refers to a circular center in the circular heater as in this embodiment.

In this embodiment, as shown in FIG. 4, the sub-tank heater 33 is separated by the predetermined distance from the ink inflow port 25*d* in the sub-tank 25. Therefore, the temperature of the ink near the ink inflow port 25*d* locally reaches the target temperature, as described above, but it is easy to avoid the occurrence of the temperature distribution in which the temperature of the ink farthest from the ink inflow port 25*d* on the opposite side is considerably lower than the target temperature.

Specifically, when the ink with the normal temperature flowing from the inflow port (an upstream end 27*a*) of the sub-tank 25 flows in by a predetermined distance from the ink inflow port 25*d*, the first temperature sensor 32 detects the temperature of the ink with the normal temperature and the sub-tank heater 33 heats the ink. The ink flowing mainly above the sub-tank heater 33 readily joins the flow of the ink circulating from the ink circulation pipes 55 and thus readily flows below the sub-tank heater 33. The ink moving and flowing down slightly from the ink inflow port 25*d* is heated while the ink flows near the sub-tank heater 33. Since the ink is mixed by the flow of the ink and is heated while the ink flows from the main tank 15, the temperature distribution of the ink of the sub-tank 25 rarely occurs. Moreover, since the ink is mixed and heated by the flow of the ink from the ink circulation pipes 55 during the circulation of the ink, the temperature distribution of the ink of the sub-tank 25 rarely occurs.

When the ink is locally heated near the sub-tank heater 33, the heat may have an adverse influence on the ink. For this reason, the first temperature sensor 32 is disposed at the position at which the adverse influence of the heat does not occur. While the ink is heated, a temperature distribution may occur in that the temperature of the ink near the sub-tank heater 33 is high and the temperature of the ink distant from the sub-tank heater 33 is low. For example, when the first temperature sensor 32 is too far away from the sub-tank heater 33, the temperature of the ink near the sub-tank heater 33 is considerably increased, the temperature of the ink near the position of the first temperature sensor 32 reaches the target heating temperature, and thus the sub-tank heater 33 stops the heating at this time. In this case, since the temperature of the ink near the sub-tank heater 33 is considerably increased and thus the heat may have an adverse influence on the ink. Alternatively, when the first temperature sensor 32 is too close to the sub-tank heater 33, the sub-tank heater 33 stops the heating at a time, at which the temperature of the ink near the sub-tank heater 33 reaches the target heating temperature, in spite of the fact that the temperature of the ink in the circumference separated from the sub-tank heater 33 is considerably lower than the target heating temperature. For this reason, in order to avoid the occurrence of the temperature distribution at both ends, the first temperature sensor 32 is disposed at the position spaced from the sub-tank heater 33 by an appropriate distance. The position at which the first temperature sensor 32 is disposed is set in the range of the half of the depth from the liquid level A2 to the sub-tank heater 33 in a depth direction at the center of the intermediate position between the sub-tank heater 33 and a liquid level (for example, the liquid level A2 in FIG. 4) when the inflow of the ink from the main tank 15 stops. In particular, in this example, the first temperature sensor 32 is disposed at a position slightly closer to the sub-tank heater 33 than the intermediate position between the liquid level A2 and the sub-tank heater 33 in the range in the depth direction.

A pipe portion 47*c* (pipe passage) having a predetermined length and forming a part of the third ink supply pipe 47 on the upstream end thereof is inserted along the bottom surface of the sub-tank 25 so as to extend at the position slightly above the bottom surface of the sub-tank 25. An inflow port 47*d* of the pipe portion 47*c* is opened at a position which is opposite to the ink inflow port 25*d* and to which the ink flowing from the ink inflow port 25*d* crosses across the inside of the sub-tank 25. Here, the insertion position of the pipe portion 47*c* is determined under the condition that the pipe portion 47*c* is inserted only by a predetermined length crossing the half or more of the sub-tank 25 until the inflow port 47*d* reaches the position opposite to the ink inflow port 25*d* relative to the imaginary surface perpendicular to an imaginary line binding the center of the ink inflow port 25*d* and the sub-tank heater 33 and passing through the center of the sub-tank heater 33. Therefore, the ink heated by the sub-tank heater 33 while the ink flows from the main tank 15 to the sub-tank 25 and crosses the inside of the sub-tank 25, or the ink flowing near the inflow port 47*d* while being mixed and heated to the average temperature flows from the inflow port 47*d* of the pipe portion 47*c*, as indicated by an arrow of FIG. 4. Therefore, the ink with the normal temperature just flowing in the sub-tank 25 is stopped from flowing from the inflow port 47*d* of the pipe portion 47*c* to the third ink supply pipe 47.

The pipe portion 47*c* extends along the bottom surface of the sub-tank 25. Therefore, even when the ink flows below the sub-tank heather 33 during the flow of the ink in the pipe portion 47*c*, the ink is also heated. The sub-tank heater 33 is disposed at the position separated from the pipe portion 47*c* by an appropriate distance so that the ink passing the pipe portion 47*c* is appropriately heated. Even when the ink which is not sufficiently heated flows from the inflow port 47*d* of the pipe portion 47*c* at the time at which the ink intermittently flows from the main tank 15, the ink is heated while flowing in the pipe portion 47*c* and passing below the sub-tank heater 33. Therefore, the ink heated to the first target temperature mainly flows from the sub-tank 25 to the third ink supply pipe 47. When the ink does not flow from the main tank 15, the sub-tank heater 33 just heats the ink heated to the first target temperature to the degree of keeping the temperature of the ink. Therefore, even when the ink flowing in the pipe portion 47*c* extending along the bottom surface of the sub-tank 25 flows below the sub-tank heater 33, the ink is rarely heated by the sub-tank heater 33. Accordingly, the ink excessively heated in the sub-tank 25 does not flow to the third ink supply pipe 47. The pipe portion 47*c* extending near the bottom surface of the sub-tank 25 is disposed at the depth slightly below the liquid level A2 and at the position spaced opposite to the ink inflow port 25*d*, to which the ink with the normal temperature flows, with reference to the sub-tank heater 33 in the depth direction. Therefore, the ink passing through the pipe portion 47*c* can be easily prevented from being cooled by the ink with the normal temperature just flowing from the ink inflow port 25*d*.

The heated ink flows from the ink circulation pipes 55 by circulating the ink supplied from the sub-tank 25 to the printing heads 43 and via the third ink supply pipe 47 again from the printing heads 43 to the sub-tank 25 via the third ink supply pipe 47. At this time, when the ink with the normal temperature flows from the ink inflow port 25*d* to the sub-tank 25, the ink with the normal temperature is mixed with the heated ink flowing from the ink circulation pipes 55, thereby preventing the temperature of the ink of the sub-tank 25 from being rapidly dropped. In addition, even when the temperature distribution of the ink of the sub-tank 25 occurs during the heating after the end of the inflow of the ink with the normal temperature or the temperature is not yet sufficiently stabilized, the temperature of the ink of the sub-tank 25 is averaged and the ink temperature and the target temperature are converged by the inflow of the heated ink, which is slightly cooled from the target temperature, flowing from the ink circulation pipes 55 and the mixing operation caused by the ink flow upon the inflow of the ink. Therefore, a gap between the temperatures of the ink heated at the appropriate temperature in the sub-tank 25 can be reduced. Accordingly, the ink stabilized in the temperature since the gap between the temperatures is reduced can be supplied to the third ink supply pipe 47.

For example, when the ink is not circulated during the printing and only the ink necessary for the printing heads 43 is supplied, the ink is readily cooled at the position where the second heating device 72 is not disposed in the third ink supply pipe 47. For this reason, the temperature distribution may occur in that the temperatures are different due to a positional difference in the third ink supply pipe 47 in the longitudinal direction. Since it is difficult to solve the temperature distribution just occurring in the third ink supply pipe 47, the temperature distribution has an influence on the ink ejection performance of the printing heads 43. In this embodiment, however, since the ink is circulated during the printing from the printing preparation period and the standby period after the end of the printing, the temperature distribution due to the positional difference in the third ink supply pipe 47 in the longitudinal direction does not occur.

As described above, the sub-tank heater 33 is disposed at the position slightly above the pipe portion 47*c* extending along the bottom surface of the sub-tank 25. The sub-tank heater 33 is disposed nearly at the center of the tubular sub-tank 25 in the horizontal direction in the state where the sub-tank heater 33 is located slightly closer to the bottom surface than the depth position of the half of the depth from the liquid level A2 to the bottom surface when the inflow of the ink from the main tank 15 is stopped. The first temperature sensor 32 is disposed closer to the opposite side (closer to the left end in FIG. 4) of the end of the ink inflow port 25*d* with reference to the center of the circular shape of the sub-tank heater 33 and is disposed at the range in which the intermediate position of the half of the depth from the liquid level A2 to the sub-tank heater 33 is located at the center. In particular, the first temperature sensor 32 is located at the position closer to the sub-tank heater 33 than the intermediate position of the range.

In this way, the ink of the sub-tank 25 is heated up to the first target temperature by the sub-tank heater 33. However, it is difficult to eliminate the temperature distribution of the ink in the sub-tank 25. Moreover, when the ink with the normal temperature flows intermittently from the main tank 15, the temperature distribution has a tendency to occur easily. For this reason, the ink flowing from the sub-tank 25 to the third ink supply pipe 47 via the pipe portion 47*c* is heated mainly to the first target temperature, but there is a slight difference in the temperature.

Next, the configuration of the second heating device 72 will be described with reference to FIG. 1 and FIGS. 5 to 7. As shown in FIG. 1 and FIGS. 5 to 7, the second heating device 72 includes a heat transfer member 74 installed inside the connection pipes 48, a supply passage heater 54 installed in the heat transfer member 74, and a third temperature sensor 53 installed in the heat transfer member 74 and detecting the temperature of the heat transfer member 74. The heat transfer member 74 is configured to transfer the heat of the supply passage heater 54 and heat the connection pipes 48.

As shown in FIGS. 6 and 7, the heat transfer member 74 includes a heat transfer plate 76 with the same square plate shape and nearly the same size as those of a heat transfer block 75 with a square plate shape. A plurality of guide grooves 75*a* is formed on the surface facing the heat transfer plate 76 of the heat transfer block 75. The plurality (N) of connection pipes 48 are interposed between the heat transfer block 75 and the heat transfer plate 76 in the state where the connection pipes 48 are received in the guide grooves 75*a*, respectively. As shown in FIGS. 6 and 7, the supply passage heater 54 is attached to the surface of the heat transfer block 75 of the heat transfer member 74. The third temperature sensor 53 is attached to the surface of the heat transfer block 75 of the heat transfer member 74 at the position slightly spaced from the supply passage heater 54. Of course, the third temperature sensor 53 may be attached to the surface of the heat transfer plate 76 opposite to the arrangement position of the supply passage heater 54 of the heat transfer member 74.

In this embodiment, the heat transfer block 75 and the heat transfer plate 76 forming the heat transfer member 74 are made of aluminum-based metal (for example, aluminum or aluminum alloy) with high heat conductivity. The connection pipe 48 is made of an iron-based metal (for example, stainless steel) with high ink corrosion resistant property. In addition, the heat transfer member 74 is joined to the connection pipe 48 received in a guide passage 74*a* by soldering. Of course, when the material of the heat transfer member 74 has low heat conductivity and an ink corrosion resistant characteristic, the guide passage 74*a* of the heat transfer member 74 may be configured as a passage with a circular cross-section, for example, and this passage may be used as the connection pipe.

As shown in FIG. 5, the N (for example, four) connection pipes 48 extend to be adjacent to each other and nearly parallel to each other at a nearly uniform interval. The connection pipes 48 are installed along a meandering predetermined path. The N connection pipes 48 with a small pipe diameter extend to be long and thin in the meandering path. When the connection pipes 48 extend to be long and thin in the meandering path, the broad contact areas of the connection pipes 48 and the heat transfer member 74 can be ensured. Moreover, the broad contact areas of the connection pipes 48 installed in the heat transfer member 74 and the ink flowing in the connection pipes can be ensured. For this reason, the heat of the supply passage heater 54 can effectively be transferred to the ink flowing in the connection pipes 48 via the heat transfer member 74.

As shown in FIG. 5, the connection pipes 48 are installed to be adjacent to each other distantly and parallel to each other at the nearly uniform interval along the meandering path. Therefore, it is possible to realize the pipe structure in which the difference in the temperature hardly occurs between the connection pipes 48. For example, when the N connection pipes are respectively installed in N independent pipe areas along the meandering path, the temperature in the pipe area of the connection pipe 48 connected to the printing head 43, in which the flow rate of the ink ejected is large, is relatively lower than that in the other pipe areas. Therefore, the temperature in the pipe area of the connection pipe 48 connected to the printing head 43 consuming a small amount of ink becomes relatively higher than that in the other areas. In this case, a problem may arise in that the temperature of the ink in the connection pipes 48 is irregular between the connection pipes 48 and the temperature of the ink in the printing heads 43 is irregular between the printing heads 43.

In this embodiment, the N connection pipes 48 may be installed to be adjacent to each other at nearly uniform intervals along the meandering path in the same area of the heat transfer member 74. Therefore, even when the temperature near the connection pipe 48 corresponding to the printing head 43 ejecting a large amount of ink is lowered, the other connection pipes 48 also pass through the area where the temperature is lowered. Accordingly, irregularities are not easily generated in the temperature of the ink in the connection pipes 48 between the connection pipes 48.

The connection pipes 48 extend to be long and thin, and thus the passage resistance R2 is increased. Even when the pulsation of the fourth pump 50 is transferred up to the entrance of each connection pipe 48 via the common pipe 47*b* without attenuation, the pulsation is attenuated and disappears due to the large dynamic pressure generated when the ink passes through each connection pipe 48. Accordingly, weak pulsation is not prevented from being transferred to the inside of the printing head 43.

The N connection pipes 48 installed along the meandering path shown in FIG. 5 have nearly the same length. Therefore, the ink flows in the thick common pipe 47*b*, where the loss of pressure is small. The nearly equal ink pressure at the entrance of each connection pipe 48 undergoes nearly the same loss of pressure when the ink passes through the connection pipes 48 with nearly the same passage length. Therefore, the ink pressures of each printing heads 43 are nearly the same between the other printing heads 43.

Next, the structure of the temperature keeping device 73 will be described with reference to FIG. 8. As shown in FIG. 8, the printing head 43 includes a head main body 80 and a head section 81 fixed to the lower portion of the head main body 80. An ink chamber 82 is formed inside the head main body 80. The connection pipe 48 and the ink circulation pipe 55 are connected to each other at the position at which the connection pipe 48 and the ink circulation pipe 55 face each other via the ink chamber 82 in the upper portion of the head main body 80. In the ink chamber 82, a filter 83 is disposed at the midway point between the upper portion communicating with the connection pipe 48 and the head section 81. The filter 83 removes bubbles or foreign particles in the ink flowing in the head section 81 in the ink flowing from the connection pipe 48 to the ink chamber 82.

The ink passing through the filter 83 from the ink chamber 82 flows to the head section 81 and is ejected as ink droplets from a plurality of nozzles 84 opened to a nozzle formation surface 81*a*, which is a lower surface of the head section 81. The same number of pressure chambers (not shown), which respectively communicate with the nozzles 84, as the number of nozzles are disposed in the head section 81. The ink droplets are ejected from the nozzle 84 by vibrating one wall portion of the pressure chamber by a pressure generating element disposed in each nozzle 84 and applying ejection pressure to the ink in the pressure chamber. Examples of the pressure generating element include a piezoelectric element, an electrostatic element, and a heater used in a thermal type ink jet printer.

As shown in FIG. 8, the temperature keeping device 73 keeping the temperature of the heated ink flowing to the ink chamber 82 is disposed on the outer wall surface of the printing head 43. In the printing head 43, a head cover 85 (heating member) made of metal is attached to the head section side from the circumference of the nozzle formation surface 81*a* of the head section 81. The head heater 45 is disposed to come into contact with the head cover 85. The second temperature sensor 44 disposed in the head heater 45 directly detects the surface temperature of the head heater 45.

With such a configuration, the control range of the temperature can be reduced when the heat of the head heater 45 is controlled so that the temperature detected by the second temperature sensor 44 approaches the third target temperature (target temperature for maintaining temperature). For example, when the ink temperature or the temperature of the head cover 85 and a heat transfer plate 86 is directly detected, the head heater 45 has already been cooled or heated considerably at the time of detecting the cooled ink or the heated ink. For this reason, deviation of the temperature of the head heater 45 becomes relatively large. However, the surface temperature of the head heater 45 is directly detected and the temperature of the head heater 45 can be kept at a nearly constant temperature (the third target temperature). Therefore, since the temperature of the printing heads 43 can be kept at the third target temperature, the advantage of keeping the temperature of the heated ink in the printing head 43 can be obtained. Accordingly, it is possible to avoid a case where the ink is excessively heated or cooled by overshoot, which is a problem when the control range of the temperature is large. In addition, since the control range of the temperature of the head heater 45 is small, the ink in the printing head 43 is kept at the third target temperature.

The heat transfer plate 86 configured to cover the side surfaces of the head heater 45 and the head cover 85 in the state where the heat transfer plate 86 comes into contact with the surface of the head heater 45 and the surface of the head cover 85 are disposed on the outer wall of the printing head 43. The heat of the head heater 45 can be transferred not only to the side surface of the printing head 43 but also the side surface of the printing head 43 via the heat transfer plate 86. Therefore, the heat of the head heater 45 can further be transferred to the side of the head section 81 and the circumference of the nozzle formation surface 81*a* via the heat transfer plate 86 and the head cover 85. The heat of the head heater 45 can be directly transferred to the head cover 85 via the contact portion of the end surfaces or can be directly transferred to the side surface of the head cover 85 via the heat transfer plate 86. Therefore, the heat can effectively transferred to the side surface of the head section 81 and the circumference of the nozzle formation surface 81*a*. The temperature keeping device 73 can be effectively keep the ink in the pressure chambers or the nozzles 84 of the head section 81. As a consequence, the ink droplets ejected from the nozzles 84 can be ejected satisfactorily.

In this embodiment, the head main body 80 is formed of a resin base and the portion including the nozzle formation surface 81*a* of the head section 81 is formed of a material with higher heat conductivity than that of the resin base of the head main body 80. In this embodiment, the portion including the nozzle formation surface 81*a* of the head section 81 is formed of, for example, silicon. The heat conductivity of silicon is higher than that of resin or ceramics, even though the heat conductivity of the silicon is lower than that of metal. In this way, the temperature of the ink in the head section 81 can be kept by transferring the heat of the head heater 45 to the circumference and the side wall of the nozzle formation surface 81*a* of the head section 81 via the heat transfer plate 86 and the head cover 85 and heating the entire head section 81 at nearly the same temperature as the temperature of the head heater 45.

In this case, it is difficult to transfer the heat to the ink in the ink chamber 82, the passage on the downstream side of the ink chamber 82, the pressure chamber, or the nozzle 84, even though the head main body 80 is heated from the outside. In this embodiment, however, the head cover 85, to which the heat is transferred from the head heater 45 via the heat transfer plate 86, heats the side of the head section 81 and the circumference of the nozzle formation surface 81*a*. Therefore, in the printing head 43 including the head main body 80 made of resin, in which it is difficult to heat the ink of the ink chamber 82, the ink has a tendency to be gradually cooled while the ink is sent from the ink chamber 82 to the downstream side. However, by heating the head section 81, the ink in the nozzle 84 or the pressure chamber located on the downstream side of the ink passage is heated. Therefore, since the temperature of the ink is appropriately kept at the third target temperature before the ink is ejected from the printing head 43, the satisfactory ejection performance of the printing head 43 is ensured.

The first heating device 71, the second heating device 72, and the temperature keeping device 73 forming the heating system realize a first heating function, a second heating function, and a temperature keeping function by the arrangement structure of the heater, the temperature sensor, and the heat transfer unit (the heat transfer member or the heat transfer plate). Moreover, the first heating function, the second heating function, and the temperature keeping function can be realized by feedback control of the heaters 33, 45, and 54 by the control device 60.

In this embodiment, the computer 61 of the control device 60 performs PID control on the heaters 33, 45, and 54 so that the temperature detected by the temperature sensors 32, 44, and 53 approaches the target temperature. The sub-tank heater 33 controls the temperature rapidly in accordance with a variation in the temperature by performing the PID control in which the control range of the temperature is large, by putting emphasis on P. The supply passage heater 54 performs the PID control so that the control range of the temperature is small in spite of putting the emphasis on P and so that the temperature is controlled rapidly in accordance with the variation in the temperature even though the supply passage heater 54 may not perform the control as the sub-tank heater 33 does. Moreover, the head heater 45 performs the PID control so that the control range of the temperature is the smallest in comparison to the other control even when the difference between the detected temperature and the target temperature is the same as that of the other control and so that the real temperature smoothly follows the third target temperature even when a variation in the temperature deviated from the target temperature occurs in the head heater 45.

Next, ink supply control and cleaning control performed by the computer 61 of the control device 60 will be described.

The computer 61 executes the supply control routine for each predetermined time (for example, a predetermined time in the range of 1 to 100 milliseconds). When the power of the printer 11 is turned off, the on-off valves 30, 37, 41, 51, and 56 are in a closed state. When the printer 11 is turned on, the computer 61 opens the on-off valves 30, 41, 51, and 56 and simultaneously drives the third pump 39 and the fourth pump 50. As a consequence, the inside of the air chamber 25*a* enters a negative pressure state by performing an operation of discharging the air from the air chamber 25*a* by the third pump 39. The ink pressure of the sub-tank 25 is depressurized since the negative pressure is applied at the liquid level A2 of the ink in the sub-tank 25. In this state, by the ejection drive of the fourth pump 50, the ink is supplied from the sub-tank 25 to the printing heads 43 via the third ink supply pipe 47. At this time, by ejection drive of the fourth pump 50, an ink ejection rate Qpump (=the ink supply rate Qin) of 20 N (cc/minute), for example, is supplied via the third ink supply pipe 47.

The lengths (passage lengths) by which the ink flows to the entrances (branch places) of the N connection pipes 48 via the common pipe 47*b* in the third ink supply pipe 47 are different. However, since the passage resistance R1 of the common pipe 47*b* is small and the loss of the pressure of the ink hardly occurs, the ink supply pressures are nearly the same as each other between the connection pipes 48 at the time at which the ink reaches the entrances of the N connection pipes 48. The passage resistance R2 of the ink flowing in the connection pipes 48 having the small pipe diameter and extending to be long and thin along the meandering path (zigzag path) is considerably increased. Therefore, the amounts of ink supplied to the printing heads 43 become equal between the printing heads 43. The pulsation of the fourth pump 50 is transferred to the entrances of the connection pipes 48 to the small degree that the pulsation is not attenuated by the damper 52. However, the delivered weak pulsation becomes almost disappears due to the dynamic pressure of the ink flowing in the connection pipes 48 with the large passage resistance R2. Accordingly, the pulsation rarely affects the inside of the printing head 43.

Here, in the printing head 43, the ink is consumed by the amount of ink ejected from the nozzles 84. At this time, the ink ejection rate Qh of ink corresponding to the duty value D at that time is consumed from the amount 20 N (cc/minute) of ink supplied to the printing heads 43. In this embodiment, when the printing is performed at the maximum (FULL) duty, the amount of ink consumed per printing head is 10 (cc/minute). The ink supply rate (Qin) (=20 N (cc/minute)) of ink larger than a maximum ink ejection rate Qhmax (=10 N (cc/minute) when all of the N printing heads 43 perform the printing at the maximum (FULL) duty is supplied by the fourth pump 50 (supply pump). Therefore, during either printing or interruption of the printing, the ink circulation rate Qout (=Qin−Qh) which is a rate obtained by subtracting the ink ejection rate Qh from the ink supply rate Qin is circulated from the printing heads 43 to the sub-tank 25 via the ink circulation pipes 55. Therefore, even when the printing is performed at the maximum duty, the ink is circulated only via the ink circulation pipes 55. Therefore, the ink flowing from the printing heads 43 to the ink circulation pipes 55 is not returned from the ink circulation pipes 55 to the printing heads 43. Therefore, it is possible to prevent the deterioration in the ejection characteristics of the printing heads 43 since the UV ink cooled during the flow to the ink circulation pipes 55 is returned to the printing heads 43 again and thus the temperature of the ink in the printing heads 43 falls.

Figure 9:
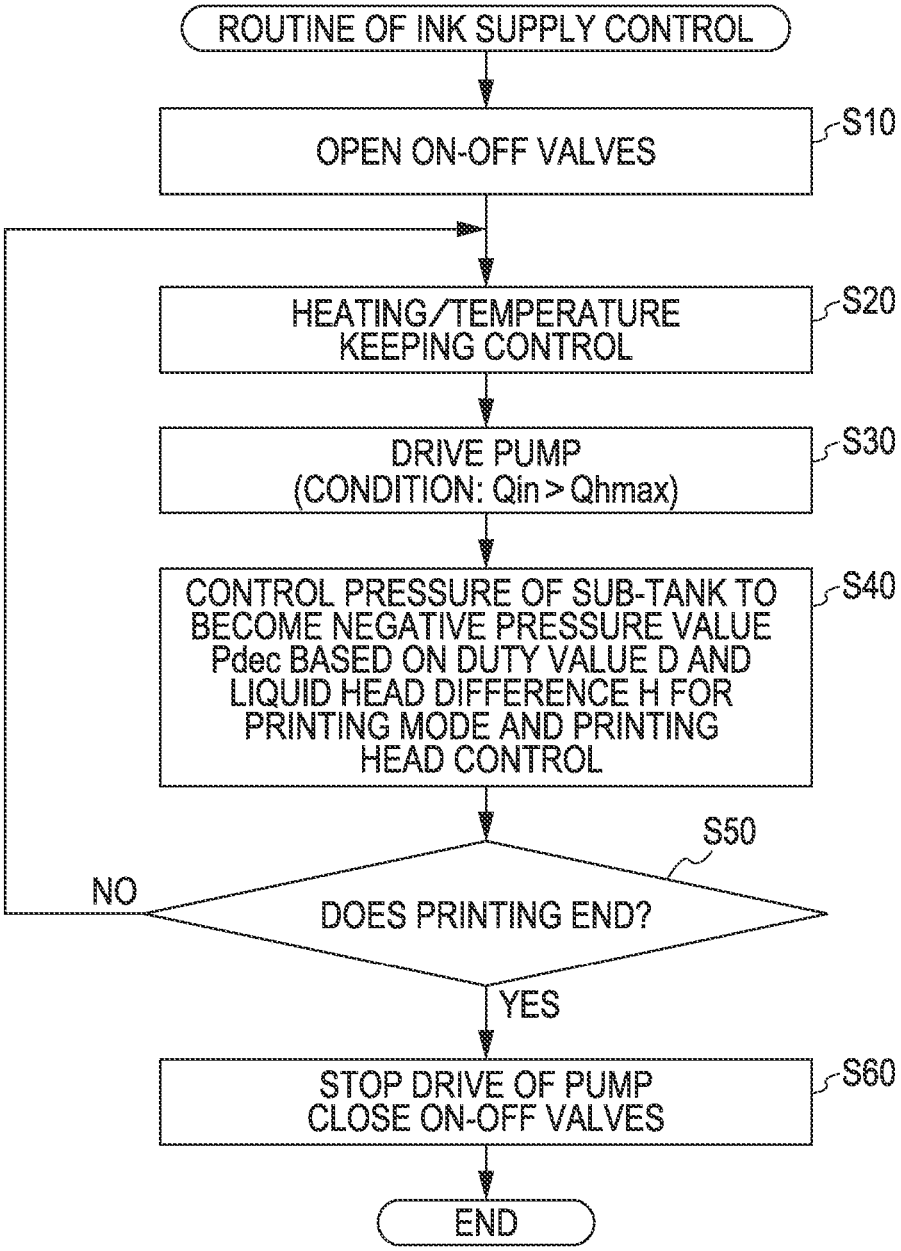
FIG. 9 is a flowchart illustrating the routine of ink supply control.
Figure 10:
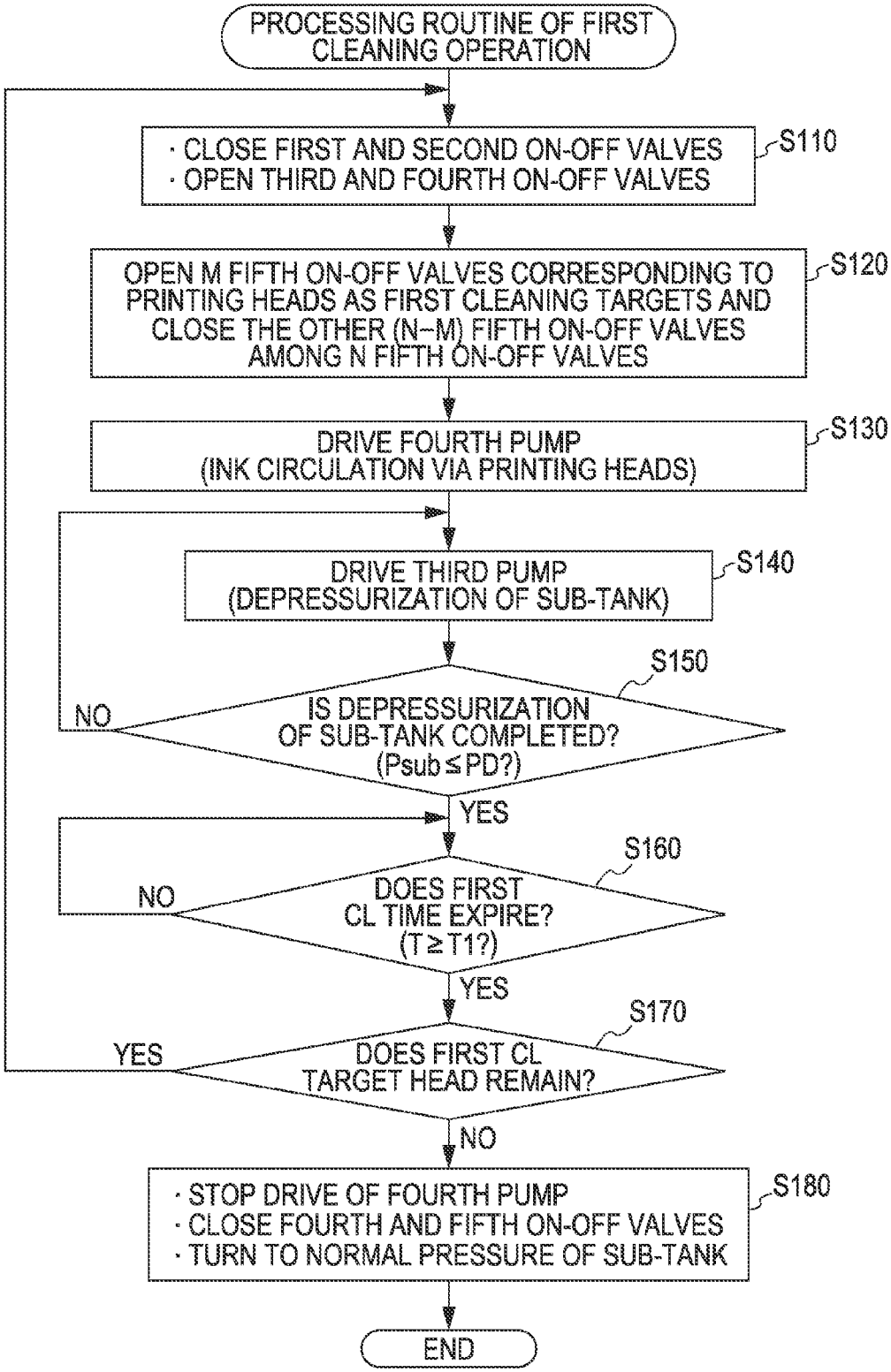
FIG. 10 is a flowchart illustrating the routine of a first cleaning process.
Figure 11:
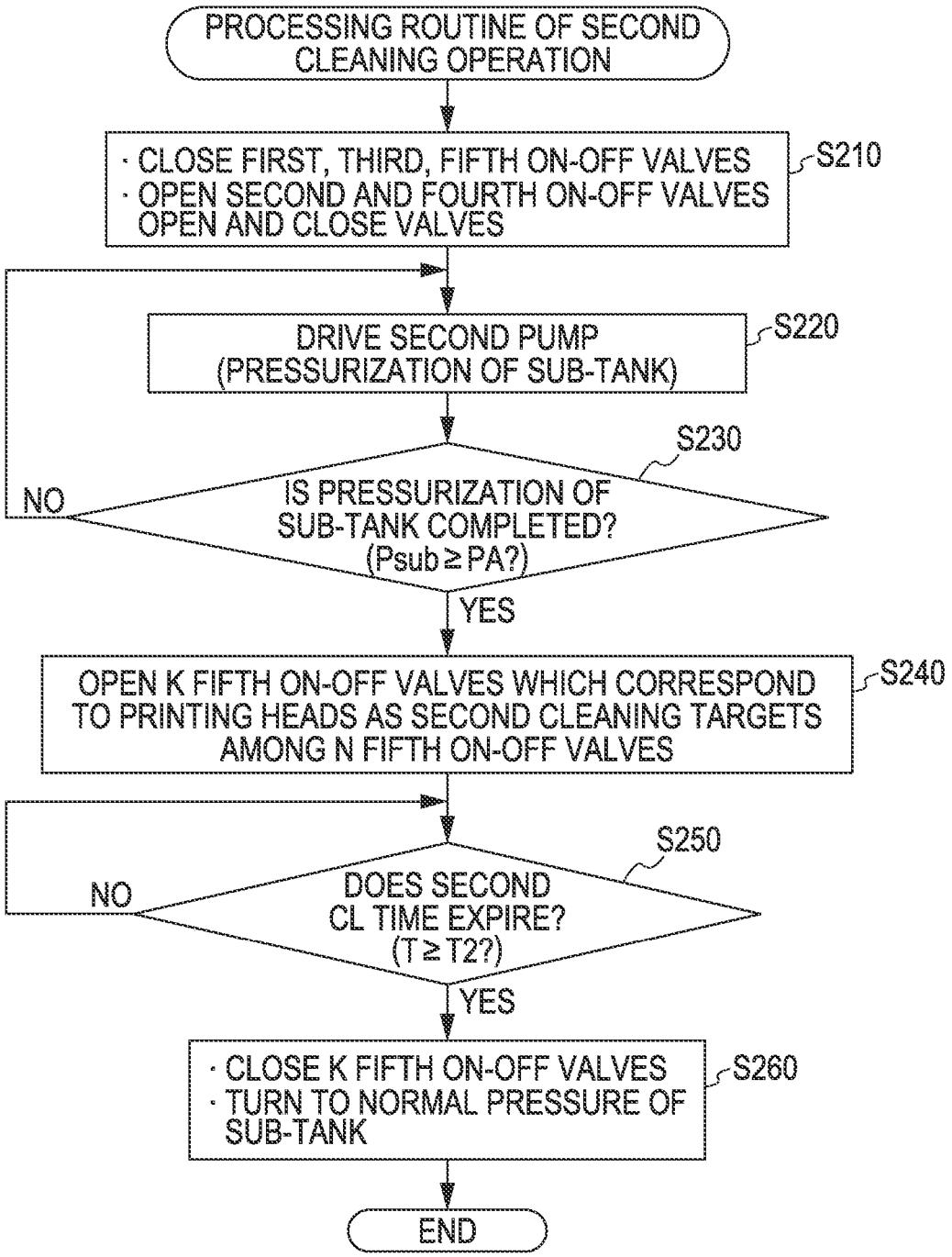
FIG. 11 is a flowchart illustrating the routine of a second cleaning process.

The ROM 68 stores a program for a print processing routine shown in the flowchart of FIG. 9 and used to execute the ink supply control at the time of the printing. When the printing starts, the computer 61 (specifically, the internal CPU 67) executes the print processing routine shown in FIG. 9 to control the supply of the ink at the time of the printing. Hereinafter, the ink supply control executed by the computer 61 at the time of the printing will be described with reference to FIG. 9. In the standby state before the printing performed by the printer 11, the ink is circulated between the sub-tank 25 and the printing heads 43. However, when a predetermined period expires in the standby state, the circulation of the ink is stopped. Here, when a printing work is received, it is assumed that the circulation of the ink stops. In this case, the on-off valves 51 and 56 of the third ink supply pipe 47 and the ink circulation pipe 55 and the on-off valves 37 and 41 of the pressure adjusting device 34 are in the closed state. The pressure adjusting device 34 is driven to adjust the temperature of the air chamber 25*a* to the target pressure in accordance with a variation in the volume of the air chamber 25*a* corresponding to a variation in the volume of the ink of the sub-tank 25.

First, in step S10, the on-off valves are opened to supply the ink to the printing heads 43. That is, the on-off valve 51 of the third ink supply pipe 47, the on-off valves 56 of the ink circulation pipes 55, and the on-off valve 41 of the pressure adjusting device 34 are opened.

In step S20, heating/temperature keeping control of the ink in the ink supply path and the printing heads is performed. The computer 61 starts the pressurizing/temperature keeping control of the ink when the printer 11 is turned on. In this step, a part of the heating/temperature keeping control performed during the printing is described. That is, the computer 61 controls the temperature of the sub-tank heater 33 on the basis of the detection result of the first temperature sensor 32. The computer 61 controls the temperature of the supply passage heater 54 on the basis of the detection result of the third temperature sensor 53. Moreover, the computer 61 controls the temperature of the head heater 45 on the basis of the detection result of the second temperature sensor 44.

In step S30, the fourth pump 50 for the ink supply is driven. At this time, the driving of the fourth pump 50 is controlled to satisfy the condition that the ink supply rate Qin (Qin>Qhmax) is larger than the maximum ink ejection rate Qhmax.

In step S40, the pressure of the air chamber 25*a* of the sub-tank 25 is controlled to become the negative pressure value Pdec based on the duty value D and the liquid head difference H for the printing mode and printing head control. That is, the target negative pressure value Pdectrg is calculated with the expression of Pdectrg=Po−Ph(H)−P3loss(D) by selecting P3loss(D) corresponding to the printing mode at that time and using the duty value D and the liquid head difference H. The computer 61 controls the third pump 39 (depressurizing pump) and the pressure opening plate 40 so that a real negative pressure value Pdecreal detected by the pressure sensor 58 is equal to the target negative pressure value Pdectrg. As a consequence, the air chamber 25*a* is controlled so that its pressure becomes the target negative pressure value Pdectrg. Specifically, when the absolute value of the real negative pressure value Pdecreal is smaller than the absolute value of the target negative pressure value Pdectrg, the computer 61 depressurizes the air chamber 25*a* until the real negative pressure value Pdectreal is equal to the target negative pressure value Pdectrg, by driving the third driving motor 38 to depressurize the third pump 39. On the other hand, when the ink is decreased in the sub-tank 25 and the volume of the air chamber 25*a* is increased, the pressure of the air chamber 25*a* is decreased and thus the absolute value of the real negative pressure value Pdecreal becomes larger than the absolute value of the target negative pressure value Pdectrg. In this way, when the absolute value the absolute value of the real negative pressure value Pdectreal is larger than the absolute value of the target negative pressure value Pdectrg, the computer 61 inputs a small amount of air into the air chamber 25*a* until the real negative pressure value Pdectreal is equal to the target negative pressure value Pdectrg, by opening the pressure opening plate 40 and opening the air chamber 25*a* to the atmosphere.

Subsequently, in step S50, it is determined whether the printing ends. When the printing does not end (that is, the printing is being performed), the process returns to step S20. Then, steps S20 to S40 are repeated until it is determined that the printing ends in step S50. When the printing ends, in step S60, the driving of the fourth pump 50 is stopped to stop the supply of the ink and the on-off valves 51 and 56 are closed to block the passages of the third ink supply pipe 47 and the ink circulation pipes 55 after the driving of the fourth pump 50 is stopped.

Next, the cleaning operation will be described. The printer 11 has a cleaning function to prevent and solve the ejection failure of the printing heads 43. As described above, the printer 11 according to this embodiment can perform the first cleaning operation to remove bubbles in the ink in the ink chamber 82 of the printing head 43 and the second cleaning operation to prevent and solve the clogging of the nozzles of the printing head 43. The first cleaning operation is performed when bubbles are mixed or are possibly mixed, for example, when the ink cartridge is replaced, the initial filling is performed, or the printer is not used for a long time.

The printer 11 include a nozzle inspecting unit (not shown) detecting whether the nozzle is clogged in each printing head 43. The control device 60 permits the nozzle inspecting unit to inspect the nozzle of the printing head 43, when a cleaning instruction is received by the operation of a user and when it is determined that a time elapsed from the end of the previous cleaning operation reaches a predetermined time on the basis of a measurement time of a cleaning timer (not shown). When there is the printing head 43 determined to have the clogged nozzle from the result obtained by inspecting the nozzles by the nozzle inspecting device, the second cleaning operation is selectively performed on the printing head 43 which is not necessary for the first cleaning operation. The ROM 68 in FIG. 2 stores the program of the processing routine of the first cleaning operation shown in FIG. 10 and the program of the processing routine of the second cleaning operation shown in FIG. 11.

First, the first cleaning operation will be described. The computer 61 performs the routine of the first cleaning operation shown in FIG. 10 at the time of performing the first cleaning operation either when the ink cartridge is replaced, the initial filling is performed, or the printer is not used for a long time.

First, in step S110, the first on-off valve 30 and the second on-off valve 37 are closed and the third on-off valve 41 and the fourth on-off valve 51 are opened. As a consequence, when the first on-off valve 30 is closed, the communication state between the sub-tank 25 and the main tank 15 are blocked. Simultaneously, when the fourth on-off valve 51 is opened, the sub-tank 25 and the printing heads 43 enter the communication state. Moreover, in the pressure adjusting device 34, a state is entered in which the second pump 36 does not communicate with the sub-tank 25 and the third pump 39 communicates with the sub-tank 25.

Subsequently, in step S120, M fifth on-off valves 56 corresponding to M printing heads 43, which are targets of the first cleaning operation at this time, are opened and the remaining (N-M) fifth on-off valves 56 are closed among N (in this embodiment, four) fifth on-off valves 56. Here, the first cleaning operation is performed a plural number of times sequentially in order on the M printing heads 43. In this step, the M printing heads 43 (hereinafter, referred to as "first cleaning target heads") are selected as the first cleaning targets and the M fifth on-off valves 56 corresponding to the selected M printing heads 43 are opened.

Specifically, M in the first cleaning operation is the maximum number of the cleaning targets per the cleaning operation. K (where $M \le K \le N$) liquid ejecting heads among N cleaning targets are subjected to the cleaning operation at least $|[-K/M]|$ (where [] is Gauss's notation and | | is an absolute value) times to perform the cleaning operation on all of the K liquid ejecting heads. For example, when the cleaning operation for one liquid ejecting head is performed on K liquid ejecting heads (where M=1), the cleaning operation for one liquid ejecting head is performed K ($=|[-K]|$) times. Alternatively, when the cleaning operation for two liquid ejecting heads is performed on seven liquid ejecting heads (where M=2 and K=7), the cleaning operation for two liquid ejecting heads is performed three times and the cleaning operation for one liquid ejecting head is performed once, that is, the cleaning operation is performed a total of four ($=|[-7/2]|$) times.

In step S130, the fourth pump 50 (supply pump) is driven. That is, the computer 61 drives the fourth driving motor 49 to drive the fourth pump 50. As a consequence, the ink supplied from the sub-tank 25 to the printing heads 43 via the third ink supply pipe 47 is circulated to the sub-tank 25 via the M ink circulation pipes 55 again.

Next, in step S140, the third pump 39 (depressurizing pump) is driven. That is, the computer 61 drives the third driving motor 38 to drive the third pump 39. When the third pump 39 is driven, the sub-tank 25 is depressurized. That is, by discharging the air from the air chamber 25*a* by the third pump 39, the air chamber 25*a* is depressurized, the negative pressure of the air chamber 25*a* reaches the liquid level A2, and thus the ink of the sub-tank 25 is depressurized.

Subsequently, in step S150, it is determined whether the depressurization of the sub-tank 25 is completed. That is, the computer 61 determines whether an air pressure (the pressure of the sub-tank) Psub of the sub-tank 25 detected by the pressure sensor 58 reaches a target negative pressure value PD (where $Psub \le PD$). When the relation of $Psub \le PD$ is not satisfied, the driving of the third pump 39 in step S140 continues. Alternatively, when the relation of $Psub \le PD$ is satisfied, the process proceeds to step S160.

In step S160, it is determined whether a first cleaning time expires. The computer 61 permits a timer (not shown) to measure the elapsed time from the start time of the first cleaning operation when the fourth pump 50 is driven and the ink circulation starts. When a measured time T of the timer reaches a first cleaning time T1 (hereinafter, also referred to as a "first CL time T1"), which is a time at which the first cleaning operation is performed ($T \ge T1$), the computer 61 determines that the first CL time T1 expires. When the first CL time T1 does not expire (when a relation of $T \ge T1$ is not satisfied), the first cleaning operation continues without change. Alternatively, when the first CL time T1 expires (when the relation of $T \ge T1$ is satisfied), the process proceeds to step S170.

In step S170, it is determined whether the first cleaning target head (first CL target head) remains. That is, when the first cleaning operation is not completed on all of the N printing heads 43 and the printing head 43 to be subjected to the first cleaning operation remains, it is determined that the first cleaning target head remains. When the first cleaning target head remains, the process returns to step S120 and the processes from steps S120 to S160 are performed on the remaining first cleaning target head to perform the first cleaning operation. Then, the first cleaning operation is performed on all of the N printing heads 43. When it is determined that the first cleaning target head does not remain in step S170, the process proceeds to step S180.

In step S180, the driving of the fourth pump 50 is stopped and the ink circulation is stopped. The fourth on-off valve 51 and the fifth on-off valve 56 are closed and the third ink supply pipe 47 and the ink circulation pipes 55 are closed. Moreover, by controlling the pressure opening plate 40 and permitting the small amount of air to flow into the sub-tank 25 from the outside, the depressurized state of the sub-tank 25 is returned to the normal pressure in the standby state of the printing. The reduced pressure of the sub-tank 25 in steps S140 and S150 is set to the variable target negative pressure value PD in accordance with the ink supply rate Qin per one printing head so that the leakage of the ink does not occur in the nozzles or the very small leakage of the ink occurs, even when the ink supply rate Qin (=the ink circulation rate Qout)

per one printing head is N/M times the value (in this embodiment 20 N (cc/minute)) at the time of the printing.

During the first cleaning operation, the amount of ink sent by the fourth pump 50 is also 20 N (cc/minute) at the time of the printing. The amount of ink sent is a substantial capability upper limit of the fourth pump 50. In this embodiment, the amount of ink flowing may not be larger than the amount of ink sent. In this embodiment, the number M of first cleaning target heads is "1". The first cleaning operation is performed one by one sequentially on the printing heads 43. M (for example, one) ink circulation pipes 55 corresponding to the first cleaning target heads are opened among the five ink circulation pipes 55 and the remaining (N−M) (for example, three) ink circulation pipes 55 are blocked. Therefore, in this embodiment of M=1, since the three ink circulation pipes 55 are blocked, the ink flows back by 20 N (cc/minute) via the one ink circulation pipe 55 corresponding to the printing head 43 which is the cleaning operation target.

All of the 20 N (cc/minute) ink flowing from the sub-tank 25 to the common pipe 47*b* due to the fourth pump 50 is circulated in the path passing through the one printing head 43 which is the first cleaning target. When all of the 20 N (cc/minute) ink corresponding to the N printing heads at the time of the printing flows to the one printing head 43, the flow speed of the ink flowing in the printing head 43 becomes faster.

In this embodiment, as shown in FIG. 8, the amount of ink flowing from the connection pipe 48 to the ink chamber 82 of the printing head 43 is N/M times (for example, four times) the amount of ink than the flow rate at the time of the printing. Therefore, the ink flowing from the connection pipe 48 to the ink circulation pipe 55 via the ink chamber 82 flows faster by N/M times the flow speed at the time of the printing. Accordingly, the bubbles gathering at the upper corners of the ink chamber 82 or the bubbles captured by the filter 83 are pushed out by the fast flow speed of the ink and thus are removed from the ink chamber 82.

Here, the ink may leak from the nozzles since the flow speed of the ink is N/M times in each printing head 43 and thus the ink pressure of the printing head 43 is increased. In this embodiment, however, since the sub-tank 25 is depressurized by driving the third pump 39, the ink pressure of the printing head 43 is also depressurized. Therefore, the increased ink pressure of the ink chamber 82 caused due to an increase in the amount of ink flowing in each printing head is nearly offset by the reduced ink pressure caused due to the depressurization of the sub-tank 25. As a consequence, the leakage of the ink from the nozzles does not occur. Even though the leakage of the ink occurs, the amount of leaking ink can be reduced to be small.

For example, the amount of ink flowing in each printing head is increased and thus the ink in the printing head is pressurized, the bubbles are compressed by the pressurizing force and thus it is difficult to detach the bubbles from the filter. In this embodiment, however, the ink of the ink chamber 82 is depressurized to offset the increased pressure corresponding to the increased amount of ink flowing. Therefore, since the bubbles in the ink of the ink chamber 82 are expanded compared to a case of no depressurization, the bubbles captured by the filter 83 are easily separated from the filter 83. In this way, by performing the depressurization of the ink for the second cleaning operation in which the amount of ink flowing in each printing head is increased, the leakage of the ink from the nozzle can be prevented or the leakage of the ink from the nozzle can be made small. Moreover, an advantage can be obtained in that the bubbles can be effectively removed. Moreover, a cap may be provided in advance which comes into contact with the nozzle formation surface of the printing head 43. Then, even when the ink leaks from the nozzle, the leaking ink can be received in the cap upon performing the first cleaning operation.

Here, the target negative pressure value PD of the depressurizing control of the first cleaning operation will be described. Since the passage resistance R of the third ink supply pipe 47 is larger than the passage resistance R3 of the ink circulation pipe 55 (where R>R3), ink pressures Pin are nearly the same as each other at the entrances of the connection pipes 48 at the time of the cleaning operation, as in the printing. A value lowered by the passage resistance R2 of the connection pipe 48 from the ink pressure Pin becomes ink pressure Phead of the printing head 43.

The ink pressure Phead of the printing head 43, which corresponds to the closed on-off valve 56 and is a non-cleaning target, is increased, as the ink gradually flows to the printing head 43 via the connection pipe 48. The flow of the ink passing the connection pipe 48 is stopped at the time at which the increased ink pressure Phead becomes equal to the ink pressure Pin at the entrance. Therefore, the ink pressure Phead of the printing head 43 converges to the same value as that of the ink pressure Pin at the entrance after a while after the cleaning starts. Here, the ink pressure Pin at the entrance can be expressed as the expression of Pin=Psub−P1loss=Psub−R1·Qpump by use of the sub-tank pressure Psub, the ink ejection rate Qpump (=Qintotal) of the fourth pump 50 (supply pump), and the passage resistance R1.

On the other hand, an ink pressure Phcl of the meniscus in the nozzle 84 of the printing head 43, which corresponds to the opened on-off valve 56 and is the cleaning target, can be expressed as the expression of Phcl=Psub−(N/M)·(P1loss+P2loss·P3loss)+Ph(H), since the ink supply rate Qin is (N/M)·Qintotal/N and the passage resistance of the connection pipe 48 is R2 when the ink flows to the printing head 43 via the connection pipe 48.

The ink pressure Phncl of the meniscus in the nozzle 84 of the printing head 43 which is the non-cleaning target is expressed as the expression of Phncl=Psub−P1loss+Ph(H).

The ink pressure Ph at the time of the first cleaning operation can be adjusted by varying the sub-tank pressure Psub, when the total number N of printing heads 43, the number M of printing heads 43 subjected to the cleaning operation, and the liquid head difference H are determined from the above two expressions. Therefore, in this example, the ink pressures Phcl and Phncl are set to values of a degree that the ink does not leak from the nozzle 84, and the negative pressure value Pdec of the sub-tank pressure Psub is adjusted. On the assumption that the ink pressure at which the ink does not leak is Phtrg2 and the target negative pressure values of the sub-tank pressure Psub for the cleaning target and the non-cleaning target are PDcl and PDncl, respectively, to satisfy the relation of Ph=Phtrg2 and PDcl and PDncl can be expressed as PDcl=Phtrg2+(N/M)·(P1loss+P2loss−P3loss)−Ph(H) and PDncl=Phtrg2+P1loss−Ph(H). The smaller one of PDcl and PDncl determined by the above two expressions is used as the target negative pressure value PD. In this embodiment, when the sub-tank pressure Psub is set to the negative pressure value PD at the time of the first cleaning operation, the leakage of the ink from the nozzle 84 can be prevented.

Next, the second cleaning operation will be described. When the cleaning timer measures the predetermined time from the end time of the previous cleaning operation or the cleaning instruction is given by the operation of a user, the computer 61 permits the nozzle inspecting device to inspect the nozzles of each printing head 43. When it is determined that the printing head 43 of which the nozzle is clogged is present from the nozzle inspection result, this printing head 43 is subjected to the second cleaning operation. When the second cleaning operation is performed, the computer 61 executes the processing routine of the second cleaning operation shown in FIG. 11. Hereinafter, the description will be made on the assumption that K printing heads 43 (hereinafter, referred to as second cleaning target heads) to be subjected to the second cleaning operation are present among the N printing heads 43.

In step S210, the first on-off valve 30, the third on-off valve 41, and the fifth on-off valve 56 are closed and the second on-off valve 37 and the fourth on-off valve 51 are opened. As a consequence, the communication state between the sub-tank 25 and the main tank 15 is blocked and all of the N ink circulation pipes 55 are blocked. Moreover, in the pressure adjusting device 34, a state is entered in which the second pump 36 communicates with the sub-tank 25 and the third pump 39 does not communicate with the sub-tank 25.

In step S220, the second pump 36 (pressurizing pump) is driven. That is, the computer 61 drives the second driving motor 35 to drive the second pump 36. When the second pump 36 is driven, the sub-tank 25 is pressurized. That is, by sending the air from the outside by the second pump 36, the air chamber 25*a* is pressurized, the pressurizing force of the air chamber 25*a* reaches the liquid level A2, and thus the ink of the sub-tank 25 is pressurized.

Subsequently, in step S230, it is determined whether the pressurization of the sub-tank 25 is completed. That is, the computer 61 determines whether an air pressure Psub of the sub-tank 25 detected by the pressure sensor 58 reaches a target increased pressure value PA (where Psub≥PA). When the relation of Psub≥PA is not satisfied, the driving of the second pump 36 in step S220 continues. Alternatively, when the relation of Psub≥PA is satisfied, the process proceeds to step S240.

In step S240, K fifth on-off valves 56 are opened which correspond to the K printing heads 43 of the second cleaning target among the N (in this example, four) fifth on-off valves 56. As a consequence, when the K fifth on-off valves 56 are opened in the state where the pressure of the sub-tank 25 is sufficiently increased, the pressurized ink is supplied from the sub-tank 25 to the K printing heads 43 via the K ink circulation pipes 55. At this time, since the third ink supply pipe 47 is closed, the pressurized ink is supplied at one time to the ink chamber 82 of the printing head 43 and the ink is strongly discharged from the nozzles of the printing head 43.

In step S250, it is determined whether a second cleaning time expires. The computer 61 permits a timer (not shown) to measure the elapsed time from the start time of the second cleaning operation after the K fifth on-off valves 56 are opened. When a measured time T of the timer reaches a second cleaning time T2 (hereinafter, referred to as a "second CL time T2"), which is a time at which the second cleaning operation is performed (T≥T2), the computer 61 determines that the second CL time T2 expires. When the second CL time T2 does not expire (when a relation of T≥T2 is not satisfied), the second cleaning operation continues without change. Alternatively, the second CL time T2 expires (when the relation of T≥T2 is satisfied), the process proceeds to step S260.

Subsequently, in step S260, the second cleaning operation is stopped by closing the K fifth on-off valves 56 to close the ink circulation pipes 55. Moreover, the pressure of the sub-tank 25 is returned to the normal pressure in the standby state of the printing by switching the on-off valves 37 and 41 of the pressure adjusting device 34, driving the third pump 39, and depressurizing the sub-tank 25.

In the second cleaning operation, unnecessary ink consumption can be reduced, since the air pressure Psub of the sub-tank 25 is increased up to the target increased pressure value PA and then the fifth on-off valves 56 are opened. For example, when the fifth on-off valves 56 are initially opened and the second pump 36 is driven to perform the pressurization, the ink may leak little by little from the nozzle of the printing head 43 while the sub-tank 25 is pressurized up to the target increased pressure value PA. The leaking ink is not strong, does not help to solve the clogging of the nozzle, and thus the ink is consumed unnecessarily. In the second cleaning operation according to this embodiment, however, the sub-tank 25 is sufficiently pressurized and then the fifth on-off valves 56 are opened. Therefore, since the ink discharged from the nozzles are initially strong, thereby helping to solve the clogging of the nozzle, the ink can be prevented from being consumed unnecessarily.

As another nozzle cleaning method, there may be considered a method of driving the fourth pump 50 in the state where all of the fifth on-off valves 56 are closed, and supplying the ink from the sub-tank 25 to the printing heads 43 via the third ink supply pipes 47 to forcibly discharge the ink from the nozzles of the printing heads 43. In this case, however, since the loss of the pressure is large when the ink passes through the connection pipes 48 with the large passage resistance, the sub-tank 25 has to be pressurized by the second pump 36 and a high ink pressurizing force has to be generated on the upstream side by an ejection force of the fourth pump 50. However, the ink discharged from the nozzles of the printing heads 43 is not strong. In the second cleaning operation according to this embodiment, however, the pressurized ink is supplied to the printing heads 43 via the ink circulation pipes 55 with the small passage resistance. Therefore, the loss of the pressure is small when the pressurized ink passes through the ink circulation pipes 55. Moreover, the ink can be strongly discharged from the nozzles of the printing heads 43.

In this embodiment, the following advantages can be obtained.

(1) The passage resistance R (≅R2>R1) of the third ink supply pipe 47 (supply passage) and the passage resistance R3 of the ink circulation pipe 55 (circulation passage) are set to satisfy the relation of R<R3. Therefore, the amounts of ink supplied to the printing heads 43 can be made nearly the same as each other. Moreover, the low ink pressure of the printing heads 43 can be maintained, while the difference in the ink pressure between the printing heads 43 is suppressed to be small. Accordingly, during the printing, an appropriate amount of ink droplets can be ejected within an allowable range of the ink pressure of each printing head 43, while the leakage of the ink from the nozzles of each printing head 43 can be prevented.

(2) The passage resistance R1 of the common pipe 47*b* of the third ink supply pipe 47, the passage resistance R2 of the connection pipe 48, and the passage resistance R3 of the ink circulation pipe 55 are set to satisfy the relation of R1<R3<R2. Therefore, the amounts of ink supplied to the printing heads 43 can be made nearly the same as each other. Moreover, the low ink pressure of the printing heads 43 can be maintained, while the difference in the ink pressure between the printing heads 43 is suppressed to be small. The ink circulation rate Qout is smaller than the ink supply rate Qin at least at the time of the printing and thus the ink circulation pipe 55 is configured to have a small diameter by this small amount, the size of the ink circulation pipe 55 can be reduced.

(3) In order to allow the variation in the ink pressure of the printing head 43 to be set within ±50 Pa, it is desirable that the passage resistance R2 of the connection pipe 48 is five or more times the passage resistance R3 of the ink circulation pipe 55. Therefore, when the relation of R2≥5·R3 is satisfied, the variation in the ink pressure of the printing head 43 can be set within ±50 Pa in any printing mode. Accordingly, the amount of ink ejected from the nozzles of the printing head 43 can be stabilized.

(4) The ink supply rate Qin of ink larger than the maximum ink ejection rate Qhmax of the printing head 43 is supplied to the printing head 43 (Qin>Qhmax) when the printing is performed with the maximum duty value Dfull (maximum ejection rate). Therefore, even when the printing is performed with the maximum duty value Dfull, the cooled ink flowing from the printing head 43 to the ink circulation pipe 55 can be prevented from flowing backward to the printing head 43. As a consequence, since the temperature of the ink of the printing head 43 can be stabilized so as to have an appropriate value, the low viscosity of the ink appropriate for the ejection can be maintained in the printing head 43. Accordingly, since a difference in the ejection performance of the ink between the printing heads 43 can be suppressed, the high print quality can be realized.

(5) In order to make the passage resistance R2 of the connection pipe 48 large, the connection pipe 48 is formed to be long and thin. Therefore, by disposing the second heating device 72 in the connection pipe 48, the ink flowing in the third ink supply pipe 47 can be effectively heated.

(6) By driving the fourth pump in the state where at least one of the on-off valves is closed in the first cleaning operation, the large amount of ink flows to the printing heads 43 of the cleaning targets by circulating the ink along the circulation passages passing from the sub-tank 25 to the printing heads 43 and the sub-tank 25 is depressurized. Accordingly, the bubbles in the ink of the printing heads 43 can be effectively removed.

(7) By allowing the third pump 39 to depressurize the sub-tank 25, the bubbles can be more effectively removed while the bubbles in the ink of the printing heads 43 are suppressed from becoming small. Moreover, the amount of ink discharged from the nozzles 84 of the printing heads 43 can be suppressed to be small.

(8) In the second cleaning operation, the fifth on-off valves 56 are opened after the second pump 36 is driven in the state where the fifth on-off valves 56 are closed and the ink of the sub-tank 25 is pressurized (accumulated pressure) up to a predetermined pressure. Therefore, a nozzle cleaning operation can be performed while the ink is suppressed from being discharged unnecessarily during the pressurization. At this time, the fourth on-off valve 51 of the third ink supply pipe 47 with the large passage resistance R is closed and the pressurized ink is sent from the sub-tank 25 to the printing heads 43 via the ink circulation pipes 55 with the small passage resistance R3. With such a configuration, the loss of the pressure is small when the pressurized ink is supplied from the sub-tank 25 to the printing heads 43. Therefore, a strong nozzle cleaning operation can be performed. Moreover, since the heated ink rarely flows to the third ink supply pipe 47 at the time of the second cleaning operation, the heated ink of the third ink supply pipe 47 is not unnecessarily discharged in the nozzle cleaning operation. Accordingly, at the time of the printing after the cleaning operation ends, the heated ink with the low viscosity in the third ink supply pipe 47 is used, and thus satisfactory printing can be performed.

(9) Since the sub-tank heater 33 is dipped into the ink of the sub-tank 25, the average temperature increase speed (heating speed) of the entirety of the ink of the sub-tank 25 can be increased.

(10) Since the sub-tank 25 is made of an inorganic material with the heat conductivity lower than metal, the heat of the ink of the sub-tank 25 is hardly dissipated via the wall of the sub-tank 25. Accordingly, the heating speed of the ink of the sub-tank 25 can be improved accordingly.

(11) The pipe portion 47*c* forming a part of the third ink supply pipe 47 on the upstream side in the sub-tank 25 is inserted so as to cross along the bottom surface of the sub-tank 25, and the inflow port 47*d* of the pipe portion 47*c* is located on the opposite side of the ink inflow port 25*d* from the main tank 15. Therefore, the ink which is not sufficiently heated immediately after the ink flows from the ink inflow port 25*d* can be prevented from being sent to the third ink supply pipe 47.

(12) Since the first temperature sensor 32 is dipped into the ink of the sub-tank 25, it is possible to increase a response speed in which the ink is heated after the real temperature of the ink of the sub-tank 25 is dropped. For example, by allowing the first temperature sensor 32 to rapidly detect the temperature of the ink flowing from the main tank 15 with the normal temperature, the sub-tank heater 33 can heat the ink rapidly. Therefore, even when the ink with the normal temperature is flowing, the ink heated at the first target temperature can be mainly supplied to the third ink supply pipe 47.

(13) Since the first temperature sensor 32 is separated from the sub-tank heater 33 by the appropriate predetermined distance, it is possible to prevent the characteristic variation caused due to excessive heating of the ink, which is a problem occurring when the first temperature sensor 32 is too close to the sub-tank heater 33 or it is possible to prevent deterioration in the response and the reduction in the average temperature increase speed of the entirety of the ink of the sub-tank 25, which are problems occurring when the first temperature sensor 32 is too far away from the sub-tank heater 33. In particular, the first temperature sensor 32 is disposed in the range of the opposite side of the ink inflow port 25*d* with reference to the center of the sub-tank heater 33 and is disposed within the range (in particular, the position closer to the sub-tank heater 33 than the center position of the range) of the half of the depth between the center position of the half of the depth from the liquid level A2 to the sub-tank heater 33 at the time of stopping the ink supply from the main tank 15. Therefore, it is possible to increase the response speed until the start of the heating when the ink with the normal temperature flows into the sub-tank 25 and the average temperature increase speed (the increase speed of the average temperature obtained by averaging the temperature distribution of the ink of the sub-tank 25) of the entirety of the ink after the start of the heating.

(14) The connection pipes 48 are heated by the heat transfer member 74 of which the temperature is nearly the same as the temperature of the supply passage heater 54 by transferring the heat of the supply passage heater 54 in the state where the connection pipes 48 pass through the heat transfer member 74 (heating block). Therefore, the heated ink in the connection pipes 48 can be heated without a difference in the temperature by transferring the heat from the heat transfer member 74 maintained nearly at the target temperature.

(15) By disposing the third temperature sensor 53 in the heat transfer member 74, the supply passage heater 54 is controlled on the detection result of the surface temperature of the heat transfer member 74. Therefore, since the heat transfer member 74 can be maintained nearly at the target temperature, the heated ink in the connection pipes 48 can be heated without a difference in the temperature by transferring the heat from the heat transfer member 74 maintained nearly at the target temperature.

(16) In the temperature keeping device 73, the head cover 85 (heating member) transferring and heating the heat of the head heater 45 is disposed on the head side wall from the circumference of the nozzle formation surface 81*a*. Therefore, the heat of the head heater 45 is transferred to the circumference of the nozzle formation surface 81*a* via the head cover 85, and thus the temperature of the printing head 43 can be kept at the target temperature from the nozzle 84 which is the downstream end of the passage. Accordingly, since the liquid in the nozzles 84 or right near the upstream side of the nozzles 84 can be maintained at the appropriate heating temperature, the ink with the low viscosity can be ejected from the nozzles 84 and thus the satisfactory ejection can be realized.

(17) The head heater 45 is controlled on the basis of the detection result of the surface temperature of the head heater 45 by disposing the second temperature sensor 44 in the head heater 45. With such a configuration, since the head heater 45 can be maintained at the target temperature, the heat of the head heater 45 maintained at the target temperature can be transferred to the circumference of the nozzle formation surface 81*a* via the head cover 85. Therefore, even when the head main body 80 is made of resin, the head section 81 can be maintained at the target temperature. As a consequence, since the liquid in the nozzles 84 or right near the upstream side of the nozzles 84 can be maintained at the appropriate heating temperature, the satisfactory ejection of the ink droplets can be realized.

(18) Since the heat of the head heater 45 is transferred to the head cover 85 via the heat transfer plate 86, the heat can effectively be transferred to the head cover 85.

The above-described embodiment may be modified in the following other forms.

The second cleaning operation is not limited to the method of driving the third pump 39 (pressurizing pump). For example, the second cleaning operation may be performed by driving the fourth pump 50 (supply pump). That is, the N fifth on-off valves 56 disposed in the ink circulation pipes 55 are closed to drive the fourth pump 50. The ink is sent to the printing heads 43 via the third ink supply pipe 47 by the driving of the fourth pump 50 in the state where the flow of the ink is blocked by the fifth on-off valves 56 closing the ink circulation pipes 55 on the downstream side of the printing heads 43. Therefore, the ink pressure of the printing heads 43 is increased at one time and thus the ink is strongly discharged from the nozzles.

Figure 12:
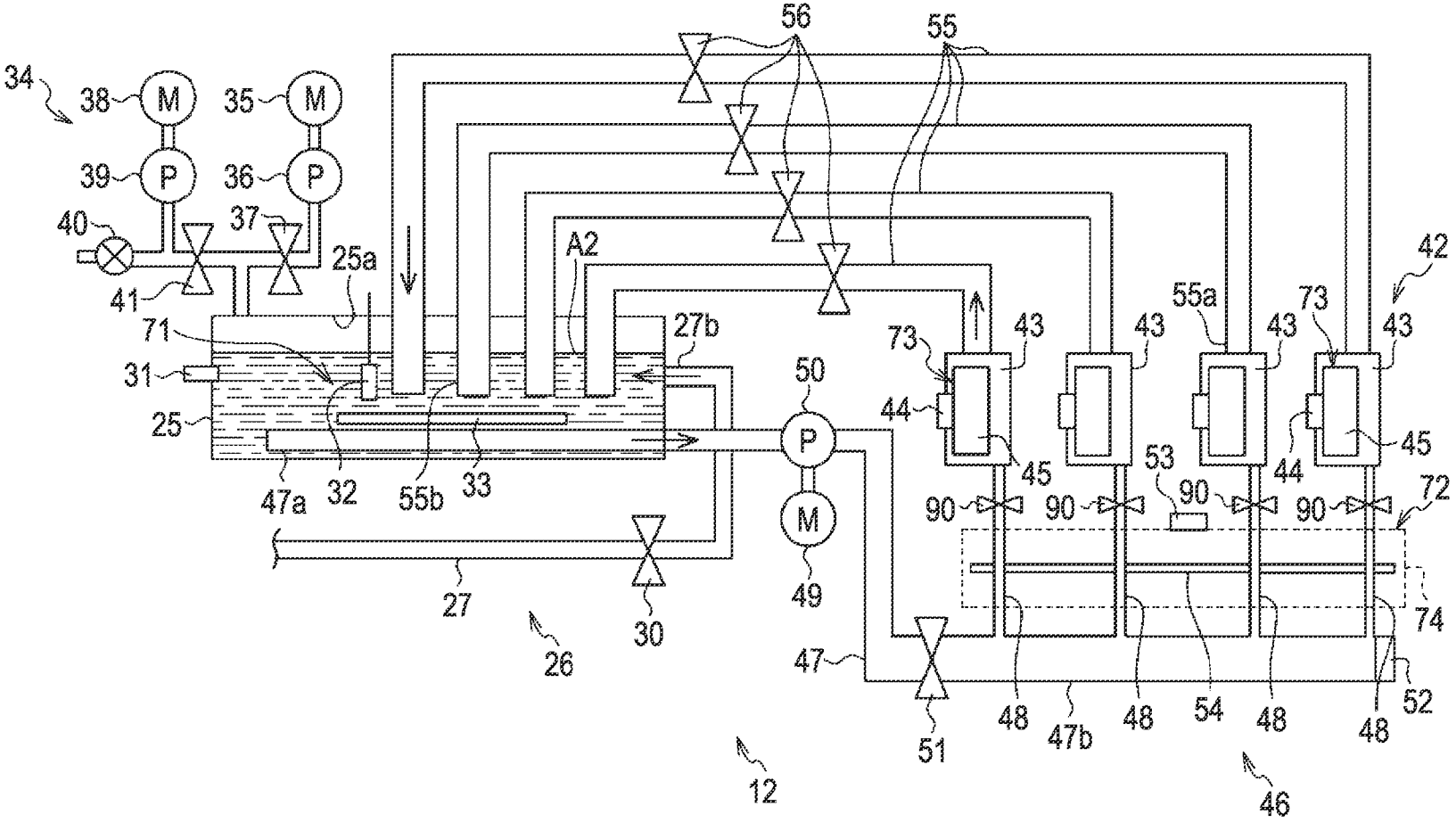
FIG. 12 is schematic view illustrating a part of a printer according to a modified example.

The configuration and the method of performing the second cleaning operation (nozzle cleaning operation) to solve the clogging of the nozzles can be used in a configuration and a method shown in FIG. 12. For example, by driving the fourth pump 50 in the state where all of the fifth on-off valves 56 are closed, it is possible to use the configuration and the method of discharging the ink from the nozzles of the printing heads 43. In this case, as shown in FIG. 12, N sixth on-off valves 90 are disposed in the connection pipes 48 branching from the third ink supply pipe 47 in parallel. By driving the fourth pump 50 (supply pump) in the state where all of the sixth on-off valves 90 are closed, the pressure of the ink on the upstream side of the sixth on-off valves 90 is made to accumulate. M sixth on-off valves 90 corresponding to the printing heads 43 of the cleaning targets are selectively opened at the time at which the ink pressure is sufficiently increased (at the time at which the accumulation of the pressure ends) to realize the nozzle cleaning operation. In this way, the nozzle cleaning operation may be realized not only by the fifth on-off valves 56 disposed in the ink circulation pipes 55 but also by the fourth pump 50 sending the ink from the sub-tank 25 to the printing heads 43 via the third ink supply pipe 47 and the sixth on-off valves 90 disposed on the connection pipes 48. In this case, the heated ink stored in the third ink supply pipe 47 is supplied to the printing heads 43 and the ink is discharged to perform the cleaning operation. However, since the printing heads 43 are filled with the heated ink after the end of the cleaning operation, the heated ink is satisfactorily ejected in the next printing. As in the above-described embodiment, when the pressurized ink flows backward in the direction opposite to the supply direction via the ink circulation pipes 55, the ink cooled in the ink circulation pipes 55 flows into the printing heads 43. Thereafter, the printing may not start for a while until the ink in the printing heads 43 is heated. In the second cleaning operation, however, the ink flows in the supply direction and the printing heads 43 are filled with the heated ink after the end of the nozzle cleaning operation. Therefore, the printing can start after a relatively short time until the temperature is stabilized.

By selectively opening and closing the N sixth on-off valves 90 in FIG. 12, the first cleaning operation may be performed. That is, the ink is circulated along the circulation path passing through the M printing heads 43 of the cleaning targets, by driving the fourth pump 50 (supply pump) after the M sixth on-off valves 90 selected as the cleaning targets among the N sixth on-off valves 90 are opened. Of course, when the fifth on-off valves 56 are also disposed in the ink circulation pipes 55, as in FIG. 12, at least the M fifth on-off valves 56 corresponding to the printing heads 43 of the cleaning targets are opened. When the first cleaning operation is performed, the ink pressure Phncl of the printing head 43 of the non-cleaning target blocked by the closed sixth on-off valve 90 is not taken into consideration. Therefore, Phcl may be set as the negative pressure value PD of the sub-tank pressure Psub. The position of the fourth pump 50 serving as the supply pump may be moved to the side of the ink circulation pipes 55 in the state where the liquid can be sent to the circulation direction, and the second cleaning operation may be performed by allowing the ink to flow along the path passing through the third ink supply pipe 47 (supply passage). In this case, the second cleaning operation is performed by driving the third pump 39 (pressurizing unit) in the state where the N sixth on-off valves 90 are closed, pressurizing the sub-tank 25 to form the pressure accumulation state, completing the accumulation of the pressure, opening the M sixth on-off valves 90, and then sending the ink to the M printing heads 43 via the third ink supply pipe 47 (supply passage). When the first and second cleaning operations are performed by selectively opening and closing all of the sixth on-off valves 90, the fifth on-off valves 56 of the ink circulation pipes 55 may be eliminated.

In the embodiment, the sub-tank 25 serving as a tank may be configured as a plurality of units to correspond to the printing heads 43, respectively. In this case, the downstream end of the ink circulation pipe 55 may be inserted into or connected to each sub-tank 25.

In the embodiment, one of the main tank and the sub-tank may be provided. By providing only one tank, the configuration may be formed between the one tank and the printing heads 43 to supply and circulate the ink. The ink cartridge may be used as a tank. In this case, when the ink cartridge is mounted on the holder unit, the ink cartridge may be connected to the upstream end of the supply passage and the downstream end of the circulation passage and may be also connected to one end of the passage connected to the second pump 36, the third pump 39, and the pressure opening plate 40. In the ink cartridge, the ink may be stored in a case or an ink pack may be received in the case.

In the embodiment, by disposing one variable throttle plate in each ink circulation pipe 55 to adjust a throttle amount of the variable throttle plate, the passage resistance R3 of the ink circulation pipes 55 may be adjusted together or separately. For example, by controlling the adjustment of the throttle amount of the variable throttle plate in accordance with the duty value D, the ink pressure of the printing heads 43 may be adjusted to an appropriate value.

In the embodiment, the negative pressure value upon depressurizing the sub-tank 25 may be obtained in the following method. The negative pressure value is obtained by analyzing print data (liquid ejection processing data), calculating the number of print dots per unit time, estimating the ink ejection rate (cc/minute) from the value corresponding to the number of print dots calculated, and obtaining a negative pressure value corresponding to the estimated ink ejection rate with reference to table data. For example, the maximum ink ejection rate Qhm (cc/minute) during the course (that is, during the printing period) of completing the printing may be calculated on the basis of the print data, a given value Qo may be added to the maximum ink ejection rate Qhm, and the ink supply rate Qin (=Qhm+Qo) may be calculated. For example, the given value Qo is set to a value of the necessary ink circulation rate Qout or the ink circulation rate Qout+a margin rate. In this case, the ink larger than the given value Qo flows in the circulation passage from the start of the printing to the end of the printing.

By analyzing the print data (liquid ejection processing data) and sequentially calculating and estimating the amounts of ink ejected after a predetermined time expires in the range from 10 milliseconds to 10 seconds from the present time during the printing on the basis of the analysis result, the depressurization of the sub-tank 25 may be controlled in real time to obtain the negative pressure value corresponding to the amount of ink ejected at that time. Here, the predetermined time corresponds to a response time expressed as the sum of an amount of time required until the pressure of the sub-tank 25 actually becomes the negative pressure value after the pressure control starts to set the pressure of the sub-tank 25 to the negative pressure value (target negative pressure value) and an amount of time required until the liquid pressure of the meniscus of the ink in the nozzles becomes a desired pressure after the pressure of the sub-tank 25 becomes the target negative pressure value.

In the embodiment, the ink supply rate Qin may be variable. For example, when Qhmax is variable depending on the printing mode (ejection mode), Qin may be variable in the range in which the relation of Qin>Qhmax is satisfied. When the print data (liquid ejection processing data) can be analyzed and the ink ejection rate Qh can be estimated, Qin may be variable so that the relation of Qin>Qhmax is satisfied in accordance with the estimated ink ejection rate Qh. Alternatively, the ink may be supplied by the ink supply rate Qin satisfying a relation of Qin=Qh+Qoutcnst (where, Qoutcnst is a given value) so that the ink circulation rate Qout is as constant as possible. With such a configuration, even when the ink ejection rates Qh are different from each other between the printing heads 43, the ink circulation rate Qout can be normally constant (=Qoutcnst). Therefore, the difference in the ink pressure between the printing heads 43 can be almost solved.

In the embodiment, the relation of the passage resistances may satisfy a relation of R3<R1<R2. In this case, since the passage resistance R of the third ink supply pipe 47 is determined as the passage resistance R2 of the connection pipe 48, the relation of R>R3 is constantly satisfied. In this way, by allowing the passage resistance R3 of the ink circulation pipe 55 to be the smallest among the passage resistances, the variation in the ink pressure of the printing heads 43 can further be reduced and thus the difference in the ink pressure between the printing heads 43 can further be reduced. As a consequence, the difference in the size (or weight) of the ink droplets between the printing heads 43 can be made small.

In the embodiment, one third ink supply pipe 47 may be disposed in each printing head 43. With such a configuration, when the passage resistance R of the third ink supply pipe 47 and the passage resistance R3 of the ink circulation pipe 55 satisfy the relation of R>R3, the same advantage can be obtained.

The pipe portion 47*c* (pipe passage) may be inserted so as to extend nearly in parallel to the bottom surface of the sub-tank 25. For example, the pipe passage may be inserted so as to extend nearly in parallel to the bottom surface (or the liquid level) of the sub-tank 25 above the sub-tank heater 33. Alternatively, the pipe passage may be inserted so as to extend in a direction intersecting the direction nearly parallel to the bottom surface (or the liquid level) of the sub-tank 25.

The shape of the heating block is not limited to the plate shape, but may be a rectangular shape, a cubic shape, a cylindrically columnar shape, a pyramidal shape, or a plate-shaped block with a convex portion, which extends along a portion (pipe passage of the connection pipe) in which the connection pipe passes through the inside thereof, on at least one of the front and rear surfaces. The heating block sufficient when the connection pipes are covered by the heating block is not limited to the configuration in which the connection pipe is disposed between two members (the block and the plate). For example, the connection pipe may penetrate through a through-hole formed in the heating block.

The tank may be disposed below the liquid ejecting heads or at the same height of the liquid ejecting heads in the direction of gravity. In this case, in order to ensure the ink pressure necessary in the liquid ejection head, the tank need not be depressurized but may be pressurized by a pressurizing unit during the printing (liquid ejecting operation).

The heating unit may be disposed in one of the tank and the supply passage. Alternatively, the heating unit (temperature keeping unit) may not be disposed in the liquid ejecting head. In this case, it is desirable that the chamber or the passage in the liquid ejecting head is covered with a material with a high temperature keeping property to improve the temperature keeping property of the liquid ejecting head.

The ink jet printer to which the invention is applied may be any printer such as a line printer, a serial printer, or a page printer.

During the standby state before the printing starts, the fourth pump 50 is operated to supply the amount of liquid smaller than the liquid supply rate during the printing. In this case, by applying a negative pressure to the sub-tank by the pressure adjusting device 34, the liquid is supplied to the degree that the liquid does not leak from the head. Alternatively, even in the state where the pressure adjusting device 34 is not driven, the liquid may be supplied to the degree that the liquid does not leak from the head.

In the above-described embodiment, the circulation passage may include one circulation backward passage and a plurality of discharge passages, as in JP-A-11-342634.

In the above-described embodiment, the liquid may be supplied from the main tank (ink tank) to the liquid ejecting heads via the supply passage, as in JP-A-11-342634.

In the above-described embodiment, a blocking unit is not limited to the on-off valve such as the fourth on-off valve 51. For example, the fourth pump 50 may serve as the blocking unit. For example, when the fourth pump 50 can block the flow of the liquid like a gear pump, the fourth pump 50 may be used as the blocking unit. In this case, the fourth on-off valve 51 may be eliminated.

The unit supplying/stopping the supply of the ink, which is an example of a liquid, may be an on-off valve disposed in the supply passage, in a case where the ink is supplied using the liquid head difference. That is, when the on-off valve is opened, the liquid is supplied from the tank to the liquid ejecting heads using the liquid head difference. When the on-off valve is closed, the supply of the liquid from the tank to the liquid ejecting heads is stopped.

The printing head 43 may be a piezoelectric type printing head, an electrostatic type printing head, or a thermal type printing head.

The negative pressure value of the sub-tank 25 is variable in accordance with the duty value D, but the negative pressure value may be constant.

The ink which is an example of the liquid is not limited to the UV ink. For example, the ink may be thermal cured ink, water-based or oil-based pigment ink, or dye ink.

The target is not limited to the resin film, but may be a sheet, a cloth, or a metal film.

In the above-described embodiment, the liquid ejecting apparatus is realized as the ink jet printer 11, but the invention is not limited thereto. The invention is applicable to a liquid ejecting apparatus ejecting or jetting other liquids (including a liquid-formed substance in which particles of a function material are dispersed or mixed in a liquid and a fluid-formed substance such as gel) other than ink. Examples of the liquid ejecting apparatus include: a liquid-formed substance ejecting apparatus ejecting a liquid-formed substance in which a material such as an electrode material or a coloring material (pixel material) used to manufacture a liquid crystal display device, an EL (electroluminescence) display device, and a plane emission display is dispersed or solved; a liquid ejecting apparatus ejecting a bio organic material used to manufacture a bio chip; and a liquid ejecting apparatus ejecting a liquid as a sample used by a precise pipette. In addition, there may be used a liquid ejecting apparatus ejecting a lubricant to a precision instrument such as a clock or a camera by a pin point; a liquid ejecting apparatus ejecting a transparent resin liquid such as ultraviolet cured resin on a substrate to form a minute hemispheric lens (optical lens) used in an optical communication element or the like; a liquid ejecting apparatus ejecting an etchant such as acid or alkali to etch a substrate or the like; and a fluid-formed substance ejecting apparatus ejecting a fluid-formed substance such as gel (for example, physical gel). In addition, the invention is applicable to one thereof.

The technical spirit grasped from the above-described embodiment and the modified examples will be described below.

(A) There is provided the liquid ejecting apparatus further including a liquid supplying unit supplying the liquid from the tank to the liquid ejecting heads via the supply passage. The passage resistances are set when the liquid supplying unit supplies the liquid supply flow rate of the liquid during the liquid ejection operation of the liquid ejection heads.

(B) There is provided the liquid ejecting apparatus further including a depressurizing unit depressurizing the tank. The depressurizing unit depressurizes the tank to the negative pressure upon performing the cleaning operation.

(C) There is provided the liquid ejecting apparatus further including: a plurality of on-off valves disposed in the circulation passage for the liquid ejecting heads, respectively; and a supply pump disposed in the supply passage and supplying the liquid from the tank to the liquid ejecting heads. A cleaning operation is performed by driving the supply pump in a state where all of the plurality of on-off valves are closed, sending the liquid to the plurality of liquid ejecting heads, and discharging the liquid from the nozzles of the plurality of liquid ejecting heads.

What is claimed is:

1. A liquid ejecting apparatus that includes liquid ejecting heads ejecting a liquid, comprising:

a tank that stores the liquid;

a first passage through which the liquid flows from the tank to the liquid ejecting heads; and a second passage through which the liquid flows from the liquid ejecting heads to the tank;

wherein the first and second passages define a path along which the liquid flows between the tank and the liquid ejecting heads;

wherein the liquid ejecting heads includes a first head and a second head;

wherein the first passage includes a third passage connecting to the tank, a fourth passage branching from the third passage at a first position to allow the third passage to communicate with the first head via the fourth passage, and a fifth passage branching from the third passage at a second position to allow the third passage to communicate with the second head via the fifth passage;

wherein a passage length from the tank to the first position is shorter than a passage length from the tank to the second position;

wherein the fourth passage and the fifth passage are of the same length and cross-sectional area;

wherein a cross-sectional area of the third passage is larger than a cross-sectional area of the fourth passage;

wherein a passage resistance from the tank to the first position and a passage resistance from the tank to the second position are substantially the same;

wherein a passage resistance of the fourth passage is much larger than a passage resistance from the tank to the first position;

wherein the second passage includes a sixth passage through which the first head communicates with the tank; and wherein a passage resistance of the sixth passage is greater than a passage resistance from the tank to the first position, and a passage resistance of the fourth passage is at least five times a passage resistance of the sixth passage.

2. The liquid ejecting head according to claim 1, further comprising:

a heating unit heating the liquid to supply heated liquid to the liquid ejecting heads;

wherein a flow rate of the liquid supplied to first head via the fourth passage is set to be greater than a maximum flow rate of the liquid ejected by the first head.

3. The liquid ejecting apparatus according to claim 1, further comprising:

a depressurizing unit depressurizing the tank, wherein the depressurizing unit depressurizes the tank during an ejection operation of the first head.

4. The liquid ejecting apparatus according to claim 3, wherein the depressurizing unit is controlled so that a pressure of the tank becomes a depressurization value corresponding to a flow rate of the liquid circulated in the sixth passage.

* * * * *